US007161080B1

(12) United States Patent
Barnett

(10) Patent No.: US 7,161,080 B1
(45) Date of Patent: Jan. 9, 2007

(54) MUSICAL INSTRUMENT FOR EASY ACCOMPANIMENT

(76) Inventor: William J. Barnett, 4951 N. Paynton Way, Boise, ID (US) 83713

( * ) Notice: Subject to any disclaimer, the term of this patent is extended or adjusted under 35 U.S.C. 154(b) by 0 days.

(21) Appl. No.: 11/162,526

(22) Filed: Sep. 13, 2005

(51) Int. Cl.
*G10H 1/38* (2006.01)
*G10H 7/00* (2006.01)

(52) U.S. Cl. ..... 84/613; 84/612

(58) Field of Classification Search ..... 84/609, 84/610, 613, 637, 669, 612, 636, 638, 652, 84/668
See application file for complete search history.

(56) References Cited

U.S. PATENT DOCUMENTS

| | | | | |
|---|---|---|---|---|
| 3,013,462 | A | 12/1961 | Combs | |
| 3,541,912 | A | 11/1970 | Radke | |
| 3,913,443 | A | 10/1975 | Jewett | |
| 4,018,448 | A | 4/1977 | Di Matteo | |
| 4,020,729 | A | 5/1977 | Guillemette | |
| 4,177,705 | A | 12/1979 | Evangelista | |
| D278,917 | S * | 5/1985 | Sinkoff et al. | D17/1 |
| 4,682,526 | A | 7/1987 | Hall | |
| 4,781,099 | A * | 11/1988 | Koike | 84/470 R |
| 4,970,935 | A | 11/1990 | Morikawa | |
| 4,974,486 | A * | 12/1990 | Wallace | 84/609 |
| 5,074,182 | A * | 12/1991 | Capps et al. | 84/609 |
| 5,095,799 | A | 3/1992 | Wallace | |
| 5,121,668 | A | 6/1992 | Segan | |
| 5,286,912 | A | 2/1994 | Yamaguchi | |
| 5,777,251 | A * | 7/1998 | Hotta et al. | 84/609 |
| 6,011,212 | A | 1/2000 | Rigopulos | |
| 6,018,119 | A * | 1/2000 | Mladek | 84/722 |
| 6,031,174 | A | 2/2000 | Takabayashi | |
| 6,111,179 | A * | 8/2000 | Miller | 84/442 |
| 6,362,411 | B1 | 3/2002 | Suzuki | |

OTHER PUBLICATIONS

Yamaha Model EZ-AG. Data Sheet with Photographs [online]. Yamaha Corporation of America. Retrieved on Aug. 22, 2005 from the Internet. 4pp.
<URL: http://www.yamaha.com/yamahavgn/CDA/ContentDetail/ModelSeriesDetailPF/0,,CNTID%253D24770%2526CTID%253D500946,00.html#>.
Yamaha Model EZ-EG. Data Sheet with Photographs [online]. Yamaha Corporation of America. Retrieved on Aug. 22, 2005 from the Internet. 2pp.
<URL: http://www.yamaha.com/yamahavgn/CDA/ContentDetail/ModelSeriesDetailPF/0,,CNTID%253D21546%2526CTID%253D500946,00.html>.

(Continued)

*Primary Examiner*—Jeffrey W Donels
(74) *Attorney, Agent, or Firm*—Your Intellectual Property Matters; Robert A. Frohwerk

(57) ABSTRACT

This electronic musical instrument has an extremely simple user-interface that can be played with only three fingers, one at a time. A user selects from among a small set of chords, and chooses a music-ending. This enables novices to extemporaneously produce good, simple rhythm-guitar and rhythm-banjo music to accompany singing. Strummed-guitar, finger-picked guitar, and finger-picked banjo music is composed by replaying pre-recorded elemental chording-phrases and music-ending phrases. The chording selectors also provide limited notes between strummed chords for embellishment. Optional music-endings automatically match the selected voice, key, beat, tempo and volume, nearly precluding musical errors. Common musical keys and chord types are provided to accommodate all voice ranges, and the majority of songs common to the western world. Persons capable of singing on tune can play this instrument after a brief familiarization without any practice, playing guide, or prior musical education.

23 Claims, 13 Drawing Sheets

OTHER PUBLICATIONS

Suzuki QChord. Features Sheet [online]. Suzuki Corporation. Retrieved on Aug. 23, 2005 from the Internet. 2pp. <URL: http://www.suzukimusic.com/qchord/qchord_site/features.html>.

* cited by examiner

32

32

| BEAT | |
|---|---|
| 4/4 | 3/4 |
| 84 | 92 |

| INSTRUMENT VOICE | | |
|---|---|---|
| STRUM GUITAR | FGR-PICKED GUITAR | FGR-PICKED BANJO |
| 68 | 60 | 76 |

| MUSIC KEY | | | | |
|---|---|---|---|---|
| Bb | C | D | F | G |
| 100 | 108 | 116 | 124 | 132 |

| TEMPO | | | | | | | | |
|---|---|---|---|---|---|---|---|---|
| #1 | #2 | #3 | #4 | #5 | #6 | #7 | #8 | #9 |
| 60 BPM | 78 BPM | 96 BPM | 116 BPM | 134 BPM | 152 BPM | 170 BPM | 188 BPM | 208 BPM |
| 54 & 56 | 54 & 56 | 54 & 56 | 54 & 56 | 54 & 56 | 54 & 56 | 54 & 56 | 54 & 56 | 54 & 56 |

| VOLUME | | | | | | | | |
|---|---|---|---|---|---|---|---|---|
| #1 | #2 | #3 | #4 | #5 | #6 | #7 | #8 | #9 |
| LOW | | MED-LOW | | MED | | MED-HIGH | | HIGH |
| 50 & 52 | 50 & 52 | 50 & 52 | 50 & 52 | 50 & 52 | 50 & 52 | 50 & 52 | 50 & 52 | 50 & 52 |

| MUSIC-ENDINGS: STRUMMED GUITAR | | | |
|---|---|---|---|
| END-RHYTHM / STRUMMED | | END-STRUM (ONE) | |
| STEADY | SLOWING | STRUM | ARPEGGIO |
| 148 | 150 | 152 | 154 |

| CHORDING SELECTORS | | | |
|---|---|---|---|
| #2 | #1 | #3 | #1A |
| TONIC | SUB-DOM | DOM | 2ND-DOM |
| 44 | 46 | 40 | 48 |

| MUSIC-ENDINGS: FGR-PICKED GUITAR | | | |
|---|---|---|---|
| END-RHYTHM / FGR-PICKED | | END-STRUM (ONE) | |
| STEADY | SLOWING | STRUM | ARPEGGIO |
| 148 | 150 | 152 | 154 |

| MUSIC-ENDINGS: FGR-PICKED BANJO | | | |
|---|---|---|---|
| END-RHYTHM / FGR-PICKED | | END-STRUM (ONE) | |
| STEADY | SLOWING | STRUM | ARPEGGIO |
| 148 | 150 | 152 | 154 |

| LEGEND: | Selector Identifier [Initialization] |
|---|---|
| | Beats Per Minute, or other Reference Number |

FIG. 4

Comparison of Components and Features
of the Present Invention (A) to Products B, C and D

| EXTERNAL PARTS | A | B | C | D |
|---|---|---|---|---|
| | $?? | $15 KeyBd | $20 KeyBd | $100 KeyBd |
| PLAYING- KEYS | 8 | 37+4Pads | 49+4Pads | 61 |
| SET-UP SELECTORS | 15 | 23 | 37 | 31 |
| LIGHT EMIT. DIODES | 10 | 23 | 1 | 1 |
| READ-OUT PANEL | 0 | 0 | 0 | 1 |
| MICROPHONE | 0 | 1 | 0 | 0 |
| SPEAKERS | 1 | 1 | 2 | 2 |
| JACKS | 2 | 0 | 2 | 4 |
| CASE FRONT & BACK | 2 | 2 | 2 | 2 |
| **TOTAL** | **38** | **91** | **97** | **102** |
| | | | | |
| FEATURES | A | B | C | D |
| EXTERNAL PARTS | 38 | 91 | 97 | 102 |
| # oF VOICES | 3 | 8 | 8 | 100 |
| DEMO SONGS | NO | YES/22 | YES/11 | YES/100 |
| RHYTHM SECTION | NO | YES/8 | YES/8 | YES/100 |
| PERCUSSION-PADS | NO | YES/4 | YES/4 | NO |
| POLYPHONIC-NOTES | NO | YES/2 | YES/8 | YES/12 |
| RECORD-&-REPLAY | NO | YES | YES | NO |
| MUSIC SOURCE | MEMORY | SYNTH | SYNTH | SYNTH |
| SIZE (cm) | ~28x38x5 | ~15x48x5 | ~17x56x63 | ~33x94x10 |
| SIZE (inches) | ~11x15x2 | ~6x19x2 | ~6.5x22x2.5 | ~13x37x4 |

FIG. 5

| Music keys | $B^b$ | C | D | F | G |
|---|---|---|---|---|---|
| Tonic | $B^b$ | C | D | F | G |
| Sub-dominant | $E^b$ | F | G | $B^b$ | C |
| Dominant | F7 | G7 | A7 | C7 | D7 |
| Second dominant | C7 | D7 | E7 | G7 | A7 |

FIG. 7

Playing Instructions for Exercises

[Numbers correspond to Finger-Selectors to press and hold until next chord change]

"Red River Valley" (4/4-beat Strummed guitar)

#2 _____. #3 #2 #3. #2 _____. #1 #2 #3
Then come sit here a while, ere you leave us. Do not hast-en to bid us a -dieu.

#2 _____. #1 _____. #3 _____. #2 #3 End-Rhythm
Just re-mem-ber the Red riv-er Vall-ey, and the cow-boy who loves you so true.

FIG. 8A

"Red River Valley" (4/4-beat Finger-picked guitar or banjo)

#2 _____. #3 _____. #2 _____ #3
Then come sit here a while, ere you leave us. Do not hast-en to bid us a -dieu.

#2 _____. #1 _____. #3 _____ End-Rhythm
Just re-mem-ber the Red riv-er Vall-ey, and the cow-boy who loves you so true.

FIG. 8B

"Old Rocking Chair" (3/4-beat Finger-picked guitar)

#2 _____. #3 _____.
Rock - ing alone in an old rock - ing chair,

#3 _____. #2 _____.
I saw an old mo - ther, with sil - very hair

#2 _____. #3 _____ #1 _____.
She seemed so ne - glec - ted, by those who should care

#3 _____. #1 _____ End-Rhythm
Rock - ing alone in an old rock - ing chair,

FIG. 8C

Glossary arpeggio: A slow ascending strum of the notes of a chord.

beat: A rhythmic pulse of the music; like the 4/4 and 3/4 beats.

button: The operating push-button of a selector switch.

chord: 3 or more concurrent musical tones.

chording phrase: A pair of rhythmic chord-cycles.

chording-selectors: Chord-type selectors, that play chording phrases.

chord-set: Chord-types used alternately to play songs, in a selected music-key.
- tonic chord-type: Based on the 1st tone/note of a diatonic scale.
- sub-dominant chord-type: Based on the 4th tone/note of a diatonic scale.
- dominant chord-type: Based on the 5th tone/note of a diatonic scale.
- 2nd-dominant chord-type: Based on the 5th tone/note of the 5th tone/note of a diatonic scale. (also called a five-of-five's chord-type)

cyclic-type music-ending: A pre-recorded musical phrase, of two rhythmic cycles (not always identical), followed by one strum.

line-out-jack: Plug-operated connector that switches a line from internal to external.

music-ending phrase: A tonic chording phrase of cyclic type; or a strum, or arpeggio.

music-ending-selectors: Push-buttons selectors, that play music-ending phrases.

playing selector: A chording selector or a music-ending selector; each plays music.

rhythm-guitar and rhythm-banjo music: Rhythmically strummed or finger-picked chord music, as produced on a lone instrument.

selector: A push-button operated selector switch (except power selector slides.)

tempo: The rate or speed of a piece of music.

voice: The characteristic sound of a music instrument, as strummed guitar, finger-picked guitar, and finger-picked banjo.

FIG. 10

MUSICAL INSTRUMENT FOR EASY ACCOMPANIMENT

FIELD OF THE INVENTION

The present invention relates generally to electronic musical instruments. More specifically, the present invention describes an instrument that extracts information stored in memory circuits to produce sounds that mimic those produced by stringed instruments for the purpose of accompaniment. Furthermore, the described invention may be operated by persons having little or no musical training or special abilities, and without instrument practice.

BACKGROUND OF THE INVENTION

Throughout the ages people have had a desire to express themselves through music. Although the desire persists, many people remain musically-challenged and unfulfilled. Most people can sing on tune, and though many would also enjoy playing their own instrumental accompaniment, they do not learn how to play. Others may have no difficulty recognizing a tune but run into trouble when it comes to vocalizing that tune. Singing on key is difficult for some. Others may simply be too bashful to sing, but would welcome an instrumental outlet to satisfy their musical needs. Even those who can sing well often feel more comfortable with instrumental accompaniment, while the less gifted might welcome instrumental support to assist them to maintain a tune or to mask their vocal wanderings. In a small group setting people are more likely to break into song where some form of supportive musical accompaniment is available.

A guitar is the instrument most commonly used for accompaniment. This is likely due to its relative portability and the satisfaction it provides with simple rhythmic chord music. Though many guitars are sold, a significant percentage of them are seldom played. Many would-be guitarists would rather decline an opportunity to accompany a group of singing friends than risk embarrassment for being out of practice.

There is a perceived need for a musical instrument that would allow a novice musician to play extemporaneous guitar chord music. Such an instrument would need to be no less portable than a guitar. It should be capable of producing the true melodic sounds of an acoustic guitar, with an ability to produce the true rhythmic sounds of human-played strumming and finger-picking being a desirable bonus. Furthermore, the sought-after musical instrument should be simple to play, perhaps with only one hand, requiring a minimal number of controls. It need not be so complex as to enable the performance of a lead-guitarist, but must be supportive of simple rhythm-guitar music with little initial instruction and without ongoing practice. With such an instrument, many novices who would like to play a sing-along musical instrument, like a guitar, and who are able to sing on tune would be able to easily play good extemporaneous accompaniment music for themselves as well as for others. Even musicians who play band or orchestral instruments could use such a sing-along instrument.

Others have attempted to implement hand-held electronic musical instruments, especially to mimic the guitar in structure and in playing position. U.S. Des. Pat. No. 256,366 to Dworsky (1980) disclosed an instrument with a neck, and an elongated body. The body mounted a two-and-a-half octave keyboard. Disclosed in U.S. Des. Pat. No. 289,900 to Aitken et al (1987) was a synthesizing instrument with a long neck having twenty four frets with multiple playing positions each. In 1970, Radke was granted U.S. Pat. No. 3,541,912 for a synthesizing instrument described as "a guitarlike mounting for electric organ playing means" having a bank of 24 chord-selectors on the neck, and a two-and-a-half octave keyboard on its body. Evangelista's 1979 U.S. Pat. No. 4,177,705 disclosed an electronic guitar with as many as 66 or more flexible blade-type switch actuators on the neck simulating string-fingering positions, while the body had six short flexible vanes simulating strings to strum. An instrument with a neck having a 75 zone chord-selector was the subject of U.S. Pat. No. 6,111,179 issued to Miller in 2000. It also had a body with a touch-sensitive note selector that simulated a four-octave keyboard to provide more than 150 chords and four octaves of single notes. To a novice musician most of these chords would amount to unwanted clutter.

None of these five instruments would be easy for a novice to play. They offer no relief to the novice from the need to produce good rhythm. Neither do they disclose a means to easily play limited notes between strummed chords. All apparently synthesize instrument sounds so that the technology available at a given cost will always limit their ability to produce true guitar and banjo sounds. None of them will produce professional strumming and finger-picking sounds in the hands of a novice. Their mechanical interfaces lack the simplification necessary for a novice to strum or finger-pick a chord with one finger. There has been no apparent attempt by any of them to minimize the number of chord-types and music keys for use by novices. None of the cited examples preclude the most common errors committed by novices as they learn to play, nor do these instruments significantly reduce the amount of practice required in order to produce good music. Also, their complexities are not conducive to enabling the manufacture of an instrument at a price that is appropriately low for novices.

The Yamaha Corp. attempts to address the novice level of the musical instrument market with its EZ-AG and EZ-EG portable electronic guitars. The EZ-AG model resembles an acoustic guitar, while the similar EZ-EG model resembles an electric guitar. In actuality however, these instruments are not easier to play, just easier to learn. Automated fret-lights guide the learner, similar to the illuminated keys on some musical keyboards, but playing these instruments requires all of the same actions as for any normal guitar. They have six long fret selectors on their neck portions, simulating strings on each of the twelve fret-spaces. Six short strings in the strum area of the body are picked or strummed to create electronic inputs. They have set-up selectors, rotary controls, and an electronic readout panel to control a synthesizer to simulate real instrument sounds. Several guitar and bass guitar voices are available along with a banjo and other voices. In normal playing mode, one hand must create chords by accurately fingering fret-selectors as on a guitar. Simultaneously, the other hand must skillfully strum or pick the electronic-input strings. At about $400 (in 2004) these instruments seem somewhat expensive for novices.

One approach to simplifying a musical instrument for use by novices is to use only one chord-type for each chord. U.S. Pat. No. 4,682,526 issued in 1987 to R. Hall, et al. teaches against this approach. To Hall, et al. a single chord type throughout a song is not acceptably interesting due to a perceived tendency to become very mechanical, machine-like and monotonous. Therefore, the accompaniment apparatus of Hall, et al. automatically provides many complex chord permutations selected in a constrained random manner. Their patent discloses a keyboard with additional controls, which presents some difficulty for a novice to set-up and play. The patented apparatus only synthesizes instrument sounds which inherently requires programming, and associated additional controls, for music generation. With the importance given by Hall, et al. to avoid monotony, their patent fails to disclose either a method for easily playing notes between strummed chords or of finger-picking.

U.S. Pat. No. 4,970,935 to Morikawa, et al. describes a tone information processing device for an electronic musical instrument. The authors of this patent teach against simply replaying recorded waveshapes, suggesting that simple waveshape memory type instruments may not be commercially viable, since the mere reading out of recorded external sounds from memory results in rather monotonous playback having insufficient variation in the generated tones to make them interesting. However, Morikawa, et al. fail to disclose a method for easily playing notes between strummed chords or of finger-picking.

The Omnichord musical instrument from Suzuki Music Company is basically an electronic synthesizing autoharp that is self-contained and portable, with batteries and a speaker. Novices may be intimidated by the Omnichord's array of 27 playing selectors that choose between major, minor, and seventh chords in nine music keys. One finger selects among the chords, while the other hand strums a desired beat over a pick-up zone. This music is supplemented by accompaniment from a rhythm section having five rhythm-type selections.

The Omnichord fails to enable a novice to easily produce the music of a good solo rhythm guitar. Neither does it enable a novice to easily play embellishing limited notes between strummed chords. The Omnichord is also unable to produce the trueness of guitar and banjo sounds, or human-style finger-picking sounds. Its interface would need to be simplified for a novice to play one-finger chord strumming, chord finger-picking, or music-endings, and the choice of chord-types and music keys would need to be minimized for novices. Its selector arrangement doesn't appear to have been minimized to avoid playing errors for a novice, nor to eliminate practice in order to produce good music.

Suzuki's successor to the Omnichord is their more elaborate QChord Music Instrument, Model QC-1, which is advertised to be extremely easy for novices to play. It is said to play chords in a single-finger playing mode. Although it is promoted as a Digital Songcard Guitar to play songs that are pre-recorded on plug-in memory cards, it is basically an electronic autoharp with multiple voices and an intimidating array of 36 playing selectors. Claiming several guitar voices, a banjo voice, and other voices totaling 100 in all, it has a single-finger chording mode to produce simulated strummed-guitar chord music. However, in this mode it is unable to play in a guitar voice alone without accompaniment of the rhythm-section. It cannot play any finger-picked music.

Though it cannot simulate a lone guitar in this single-finger mode, the Qchord can be played in a manual strum mode without the rhythm-section. In this case one finger selects chords, while the other hand strums a desired beat over a pick-up zone, requiring some practice to strum acceptably. The fact that a 3/4-beat is unavailable in the one-finger mode restricts the Qchord from playing many songs.

The dual functions associated with several set-up selectors and eighteen of the playing selectors on Suzuki's QChord may be confusing to novice musicians. Some users will find that the overlay-template that temporarily re-labels these dual-function selectors in order to access some features is a nuisance. Set-up is slow since the user must remember instrument numbers, or look them up. To set-up a simple guitar or banjo voice requires the user to press two selectors and read an electronic panel.

The Qchord's 36-selector array is similar to the bass-section on an accordion, though fortunately only a few selectors are used per song. A prior knowledge of music is needed to select a second-dominant chord to play with the basic three-chord set. Novices have difficulty knowing which selector to use because associated selectors cannot all be collocated. Furthermore, different sets of selectors are utilized to play in each different music-key. These complications may result in many musical errors during play.

An electric string-less toy-guitar musical instrument was disclosed in U.S. Pat. No. 5,095,799 by Wallace, et al. It synthesizes notes in an electric-guitar voice. Eight manual-note buttons are located on the body, with eight pre-programmed track buttons on the neck to play rhythmic guitar music. A user may manually select notes ad-lib, or from segments of pre-arranged musical tracks. Manual buttons can also play special sound effects. The instrument synchronizes the transitions between musical tracks, allowing its user to jump from track-to-track at any time. Track buttons play four-measure long music phrases. The instrument also synchronizes manual notes played ad-lib and inserted over the track music. Proper tempo is sustained as manual notes play over the track music. The player is essentially in complete control of the music at all times. This instrument requires substantial music-oriented programming for synthesizing, synchronizing, sequencing, repeating, and special sound effects.

The instrument of Wallace, et al. plays only in the key of C, so it is unable to accommodate all voice ranges. This guitar has adjustable tempo, but only a 4/4-beat, precluding many songs that require a 3/4-beat. Though described as a toy, this instrument offers a synthesizer having substantial music-generation programming complexity, but one that requires a person to play note buttons on the body with one hand while playing rhythm on the neck with the other hand.

Another toy guitar, having four strings, was the subject of U.S. Pat. No. 5,121,668 to Segan, et al. It synthesizes notes in an electric-guitar voice. Buttons in twelve frets are in a circle-of-chords sequence. Four short strings are electronically tuned to lower four notes of a guitar for single-note play in lead-guitar mode. In chord mode, one can press a fret button and pick string #1 for major chords. Similarly, pick #2 for minor chords, #3 for seventh chords, and #4 for diminished chords. The beat is provided by the manual picking. In auto-mode, press fret buttons and strum any strings. Any strumming causes an automatic progression of pre-programmed chording for pretended play. Special sound effects can also be played using body-mounted controls.

This instrument is rather advanced for a toy, providing many music keys and chord-types, but has not been simplified for a novice. It plays a limited strum, but cannot play any finger-picking music. While offering many playing positions, it requires two hands to play ad-lib rhythm-guitar music.

U.S. Pat. No. 6,362,411 to H. Suzuki, et al. disclosed an electronic music apparatus of the waveshape memory type along with a method for inputting music-performance control data. It records, stores and alters control data extracted from tone waveforms. The waveforms are recorded from numerous acoustic musical instruments as they are actually played in various styles of rendition. For guitars, these styles include choking, bend-downup, gliss-up, gliss-down, grace-up, grace-down, chromatic-up, chromatic-down, staccato, tenuto, vibrato, slur, shortcut, mute, hammer-on, pull-off, slide-up, slide-down, crescendo, and decrescendo, among others. It also includes variations over time for volume, pitch, and tone color. Individual waveshapes are separated into leading, middle, and ending segments, called partial sounding segments. These are stored in a database to tailor and/or augment music recordings for replay. This can also be used to adapt and enhance live music performances in real time. All of this is to provide true instrument sounds with many realistic styles of rendition. For novices this system automatically plays accompaniment tailored to previously prepared songs, however this feature is not available to play ad-lib accompaniment music.

The quantity of rendition styles offered by this instrument is considerably greater than those needed for novices to play simple rhythm-guitar accompaniment music. The disclosed complex music apparatus is not self-contained, portable, or affordable. Decomposing, altering, and re-composing waveforms uses extensive programming, and associated additional controls. This instrument goes beyond the mere storage of music phrases and their replay as-recorded under simple microprocessor control. It requires training that is considerably beyond the novice to operate this complex music-editor in order to prepare tailored songs. In spite of the numerous rendition styles offered, this disclosure fails to address easy one-finger chord strumming, chord finger-picking, or chord music-endings. Furthermore, its interface is well beyond that which can be easily managed by a novice.

Chord organs and some electronic keyboards, allow a user to play chords with a single finger. This is to provide easy accompaniment with the left hand, while the right hand plays melodies. U.S. Pat. No. 3,013,462 to Combes disclosed an adapter with eight playing-keys, and is cited here to show how chord organs have been adapted for novices. This chord-selector add-on can mount on some synthesizing electrical chord-organs to simplify the playing for beginners. While some chord organs had an intimidating array of 96 chord selectors, this adapter reduced the count to a maximum of eight available chord selectors per song, thereby reducing the intimidation factor. It did require that electrical cables be disconnected and re-connected in a different arrangement to change the music key. This patent showed that simplified chording instruments are much needed, but the technique is applicable only to keyboard instruments and not to the guitar or banjo.

Numerous patents have issued on waveform-type music instruments for arbitrary replay of musical notes that have been pre-recorded from other musical instruments. For example, in U.S. Pat. No. 3,553,340 McLoughlin disclosed a music memory that employed magnetic rotary drums. Paul Di Matteo's instrument for the storage of recorded music notes and chords on a rotary optical disc was the subject of U.S. Pat. No. 4,018,448 issued in 1977 at about the same time as Roland Guillemette received U.S. Pat. No. 4,020,729 for the use of magnetic tape loops to achieve a similar result. While these three patents disclosed various methods of replaying pre-recorded selections from various instruments, none of them addressed a method to play rhythm-guitar or rhythm-banjo music. Neither did they provide for pre-recorded music-endings. In all cases their focus was primarily on recordings of organ or piano notes which would be replayed via an organ-like keyboard which presents more difficulty than most novices are willing to attempt.

In U.S. Pat. No. 3,913,443, Aaron Jewett disclosed a musical apparatus and method for producing chordal tone background music to accompany a conventional lead instrument such as a guitar. Jewett's apparatus comprised eight latching foot pedals, wherein actuation of any pedal would cause the release of a previously latched pedal. Each pedal served as a selector for the corresponding one of eight tape tracks that had been pre-recorded with the different chordal tones of a chord set. These track recordings were synchronized for quick changes between tracks without losing a beat. This apparatus is awkward to play since feet lack the playing dexterity of fingers. The latching bar and the foot operation preclude rapid playing of notes between strummed chords with these pedals. Many cassettes are required, a different one being necessary for each combination of instrument voice, music-key, beat, and tempo. Such a multitude of cassettes would be inconvenient to carry, select, and change, precluding rapid set-up changes in a walk-around performance.

A joystick system to play live music over pre-recorded background music was the subject of U.S. Pat. No. 6,011,212 issued to Rigopulos, et al. This instrument plays a free-style melody over a user-selected pre-recorded accompaniment background track. A user must wait for the background music to begin before being enabled to play an ad-lib melody. This system for music creation is complex and costly, using a computer to aid the simplified play by a novice. A user begins by selecting a desired experience-level to play, with the novice-level limiting access to some of the instrument's capabilities while providing greater assistance. The preferred embodiment is played with a two-axis joystick, one axis providing an increase or decrease in pitch while the other increases or decreases rhythmic activity. The first of three buttons on the joy-stick is the Play button which starts the replay of background music. It also inputs melody according to the position of the joy-stick. Pressing and holding the second button sustains the melody in play. The third button repeats a particular group of notes just previously created by the player. A computer keyboard, mouse or other input device can also be used in place of a joy-stick. A chord-builder circuit constructs synthesized chords based upon pre-programmed rules. In addition to melodies, this instrument does enable ad-lib play of pre-recorded special-effects phrases including pre-built chords.

Although Rigopulos, et al. state that users of their system need no knowledge of music theory or the ability to play an instrument or keep time, the total system appears too complex for an unassisted novice to set it up from scratch before play. Even if it is only the set-up and not its use that requires knowledge of music theory and computer skills, the total system with computer would be too costly for most novices. The system comprises many discrete components and therefore lacks portability during play. While the disclosed system is said to allow a user to do essentially anything that can be done with any traditional or known instrument, this may be overstated. It is also stated that the system can generate signals representative of audible music by synthesis or sample playback. However, since it is unable to play an accompaniment of ad-lib chord music with a single play button, apparently the term sample applies only to special effects sounds.

The electronic musical instrument disclosed by Yamaguchi in U.S. Pat. No. 5,286,912 has a microphone, several key pads, a tone generator, and a storage memory. The described embodiment places the microphone on the distal end of a neck, near the singer's mouth, with playing switches on the hand-held body. This instrument is designed to allow a singer to easily take part in background play while singing a song. Pre-stored synthesized music phrases can be replayed by the key pads. Sequential combination of some phrases can produce ad-lib play. Yamaguchi's instrument can play progressions of preprogrammed synthesized chord phrases, apparently without background music. Singing and background signals are processed and output by a tone generator. Music pieces are pre-stored as note data strings on exchangeable memory cards. These define voice (color), key, timing, duration, volume, and chord progression data for chord development. The instrument also has a pitch shift circuit to create a voice duet from a voice solo. The key-on phrase play data is read out in units of phrases. Therefore, when a key pad is pressed, phrase tones for several bars are played back. An ad-lib key-on phrase play is made by pressing arbitrarily selected key pads for every several bars. This synthesizing instrument requires extensive strings of music-oriented programmed data. The programming includes composing, generating, permuting, timing, and repeating of notes, chords, and music phrases. Although quite capable, this instrument fails the novice due to the complexity of its many well-intended features. Further, this instrument does not disclose easy, rapid playing of notes between strummed chords, nor automated music endings.

Takabayashi's U.S. Pat. No. 6,031,174 disclosed an electronic apparatus and method for the generation of musical phrases. This apparatus provides an ad-lib melody music play over a rhythmic back-performance music piece. It comprises a game pad, computer, tone generator, and a speaker. The game pad has six buttons that may be pressed together in different combinations. These combinations generate address numbers 1 through 24 for the selection of solo melody phrases that must have been previously prepared for each music piece, apparently to correlate with the back-performance music piece. This apparatus generates solo musical tone signals by the phrase. A direction key on the game pad moves in eight compass-like directions to increase or decrease pitch, tempo, and volume. Two other direction keys can be custom-set for the chosen instrument voice. Users can improvise solo melody musical performance by switching between phrases with game pads. When the user selects a phrase and its start timing, the apparatus reads out the pre-stored performance data from its phrase memory and generates an associated tone signal. It is disclosed that even a novice without knowledge of musical instruments and music can play melody music with simple operations. The apparatus also generates a back-performance of rhythm music, such as drums and bases, by automatic performance techniques. In this mode the user starts the back performance which then progresses independently from the game pads. The user can also select special effects, like pitch bend. This synthesizing instrument requires extensive music-oriented programmed data strings as it does far more than to simply store and replay as-recorded music phrases under simple microprocessor control.

Takabayashi's apparatus does not enable one to play extemporaneous rhythmic chord music accompaniment, as a guitar, for an ad-lib singing performance. Instead, it uses automatic performance techniques to provide rhythmic background music, and enables a novice to extemporaneously select different melody phrases, that have been specially prepared in advance for selectable predetermined songs. As with so many others, Takabayashi's total system is too complex for a novice to set it up from scratch before play as it requires computer skills as well as knowledge of music. The total system with computer is too costly for most novices. Comprising many interconnected pieces, the lack of self-containment denies portability to this system during play. The requirement to press as many as three buttons simultaneously is confusing for novices.

Altogether, the above-mentioned instruments fail to enable the novice to easily produce an ad-lib rhythmic chord music accompaniment, such as rhythm guitar music and rhythm banjo music. They also fail to enable the novice to easily play embellishing notes between strummed chords for personal creativity. Their interfaces lack support for a novice to play one-finger chord strumming, chord finger-picking, or music-endings. Chord types and music keys have not been minimized for novices. Most playing errors have not been precluded, so that some amount of practice is necessary in order to produce good music, and the arrangements of selectors have not been conducive to a novice's playing with confidence without fear of making many musical errors.

The foregoing discussion of the work done by others is intended to develop a sense of the need for the many varied aspects addressed by the present invention that have been overlooked, neglected or denied by others. While the myriad of previous instruments may be suitably employed for their intended purposes, individually they lack suitability for the purpose which will be satisfied by the electronic instrument disclosed hereafter. Additionally, there has been no suggestion in the aforementioned patents to combine the features of one into another. There remains a need for an easily-played accompaniment-music instrument. Such an instrument should produce simple ad-lib rhythm-guitar music, and rhythm-banjo music, in a format that is preferably portable during play and optionally self-contained. For the novice who is capable of singing on tune, it should provide, with little or no practice, a means for easily playing chords and notes between strummed chords. It should allow enough freedom of musical expression to enable a novice to exercise sufficient personal creativity to attain an appropriate level of musical satisfaction.

BRIEF SUMMARY OF THE INVENTION

The musical instrument of the present invention behaves in its basic form as an electronic guitar that stores and replays basic music phrases. These phrases are pre-recorded chords and chorded music-endings derived from rhythm-guitar and rhythm-banjo music, and are replayed extemporaneously by three fingers, one at a time. This provides a continuum of live music to accompany a singer or a lead instrument. Both guitar and banjo voices may be played in finger-picking style. Limited notes may be interspersed freely between strummed guitar chords to embellish the music with freedom of expression and engender ownership of creative music. The extreme simplification of the disclosed invention, coupled with its supporting automation, almost totally preclude musical mistakes. Most novices who are capable of singing on tune will be able to play accompaniment music with the described instrument without practice. Accordingly, the specific several objects and advantages of the present invention are to provide novices with a musical instrument having the features that will be described here. A Glossary of terms used here is available in FIG. 10.

A first feature is to use pre-recorded basic music phrases of rhythmic chording, and of music endings, replayed from selected music instruments so as to require no particular playing skill. Unskilled novices simply push chording selectors and music-ending selectors to create professional sounding live music. The advantage of using recordings is that they are capable of reproducing the true melodic sounds of real instruments as well as the individual rhythmic styles of professional musicians. Live recordings impart a personality to the resulting music.

A second feature, the choice to initially mimic a guitar, is based upon the long-lived popularity of that instrument. Both strummed and finger-picked styles of rhythm-guitar music are included. This enables novices to provide musical variation by playing both strumming and finger-picking styles. Only about half of guitarists are able to play finger-picking style. Finger-picked rhythm-banjo music is an addition that would enable novices to easily play music that is beyond the ability of all but a few guitarists. A song may then be finger-picked in either the guitar or banjo voice with the same finger sequence, and a change of key would not change that finger sequence.

Third on the list of features is to include only those functional capabilities truly needed by novices. The disclosed instrument plays only rhythmically chorded accompaniment music, in a few best voices, using the most common music keys, and the most basic chord types. Chorded-type instrument music, such as that written for rhythm guitar, is crucial for accomplishing extreme instrument simplification. Rhythm-guitar music has inherent rhythm, which eliminates the need for an additional rhythm section and its associated complexity. Another advantage of this choice is that music novices also avoid the complexity of playing melodies since a guitar is not generally used to play melody music. Strummed and finger-picked guitar voices are the two most popular for chorded music with finger-picked banjo as about the third-most popular voice. The presently described instrument plays only five of the most-used keys for guitars, namely, Bb, C, D, F, and G. Furthermore, it only plays the four most basic chord types: tonic, dominant, sub-dominant, and second-dominant. With these few choices novices will still be able to easily play in all voice ranges, and to cover the majority of songs common to North America and the western world. These simplifications also enable low instrument prices, a large consideration for most novices.

A related fourth feature is to minimize the playing interface for novices. Only three fingers are necessary, and just one at a time. A single finger effectively accomplishes what has previously required the use of both hands, specifically, the equivalent of fretting guitar strings with one hand while finger-picking or strumming the strings with the other hand. The instrument of the present invention uses only four chording-selectors for playing chord music. Finger-one always rests on selector-one, finger-two on selector-two, and finger-three on selector-three. Thus, each finger has only one home, helping the user to avoid getting lost. Finger-one also presses the adjacent fourth chording-selector, but only needs to do so rarely. Finger-two also presses one of four adjacent music-ending selectors to end a song. Novices are able to play by ear after one brief familiarization, without instrument practice, playing guides, or prior knowledge of music.

A novice can add personality to the music being played by invoking a fifth feature of the presently described instrument, that it uses the same chording-selectors to also freely play limited notes between strummed chords. Thus, novices can easily embellish strummed music with freedom of expression. This surpasses mere chord-strumming and avoids boredom from playing only simple music. The interspersed notes are the lead-notes from the active basic chords so that they are always compatible. This frees novices from having to choose which notes to intersperse. Equally important, there is no need for additional playing selectors which would complicate matters for novices. This feature also avoids the need for novices to move rapidly between melody-selectors and chord-selectors. Alternatively, it avoids forcing novices to play chords with one hand while interspersing notes with the other hand.

A sixth feature of the present invention is that it provides a set of professional-sounding music-endings recorded from musicians with real instruments. These music-endings, numbering four or so, are easy for novices to play at exactly the right time after the automated chording music. Good music endings are very important because poor endings can negate an otherwise good performance. The automated music endings always match the voice, music key, beat, tempo, and volume that is in use. Music endings are in the tonic chord because most songs end in the tonic chord. Good music endings enhance the music and a set of four choices provide freedom of expression.

BRIEF DESCRIPTION OF THE DRAWINGS

The particular features and advantages of the invention as well as other objects will become apparent from the following description taken in connection with the accompanying drawings, in which:

FIG. 4 is an organization chart of the selectable functions in an implementation of the preferred embodiment showing the initialization settings;

FIG. 5 is a table comparing component count, features, and other cost considerations of the preferred embodiment to commercially available musical keyboards;

FIG. 6A is a flow chart of initial system operation at power-on;

FIG. 7 is a table of chords required to support the preferred embodiment;

FIG. 8 shows examples of playing instructions for fingering details;

FIG. 10 is a glossary of terms used here.

Figure 1:
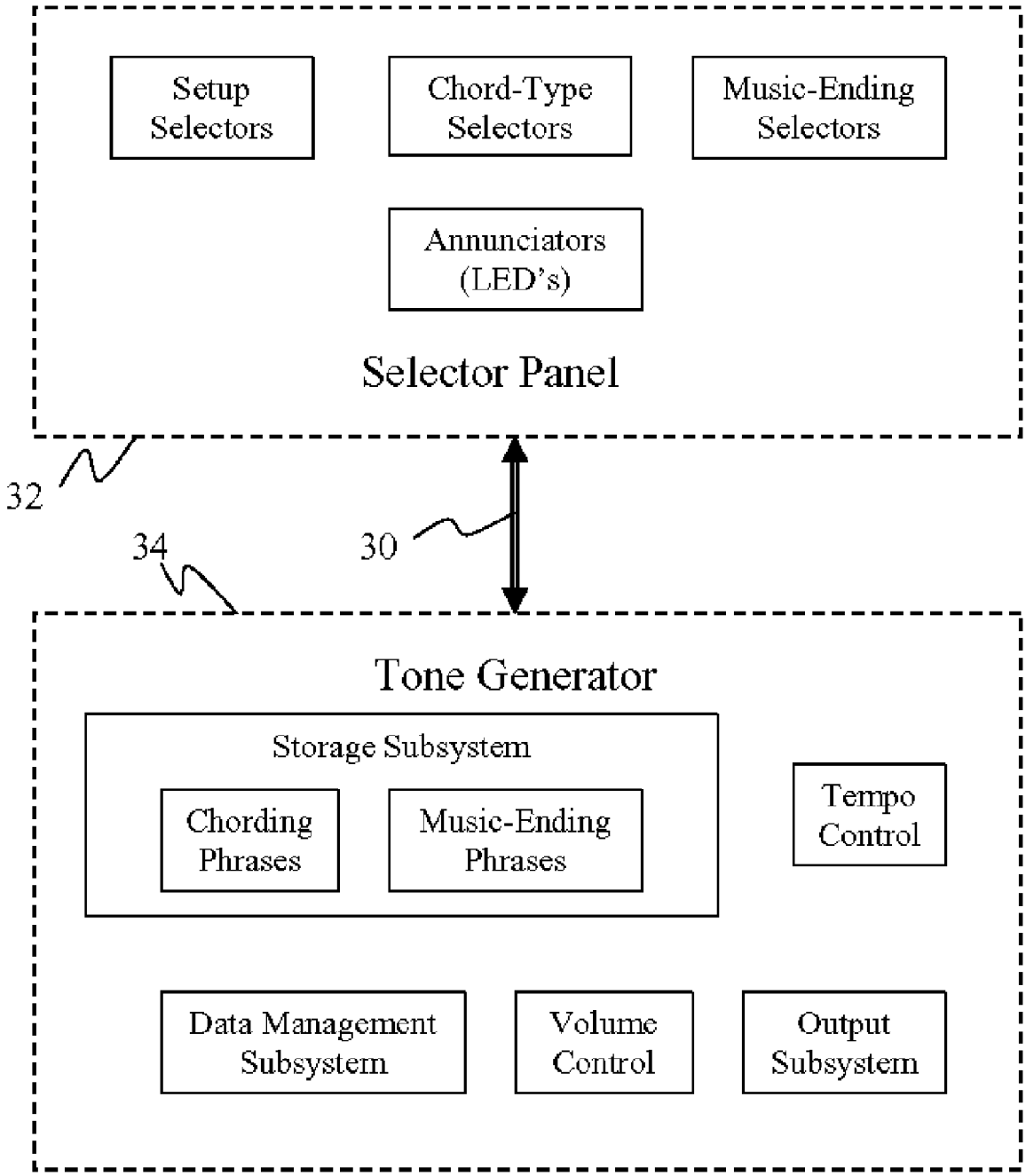
FIG. 1 is a simplified block diagram of a musical instrument system under the present invention.

The following Reference Numbers may be used in conjunction with one or more of the accompanying FIGS. 1–10 of the drawings:

20 neck, back
22 neck, front
24 guitar body, back
26 guitar body, front
28 speaker grill
30 electric cable
32 selector panel
34 tone generator
36 power on-off switch
40 selector for #3 dominant chord-type
42 selector for #3A relevant-sixth chord-type
44 selector for #2 tonic chord-type
46 selector for #1 sub-dominant chord-type
48 selector for #1A second-dominant chord-type

50 volume-up selector
52 volume-down selector
54 tempo-up selector
56 tempo-down selector
58 selector for continuous chording
60 selector for pick-guitar
64 LED annunciator for pick-guitar
68 selector for strum guitar
72 LED annunciator for strum guitar
76 selector for pick banjo
80 LED annunciator for pick banjo
84 selector for 4/4 beat
88 LED annunciator for 4/4 beat
92 selector for 3/4 beat
96 LED annunciator for 3/4 beat
100 selector for music key of Bb
104 LED annunciator for key of Bb
108 selector for music key of C
112 LED annunciator for key of C
116 selector for music key of D
120 LED annunciator for key of D
124 selector for music key of F
128 LED annunciator for key of F
132 selector for music key of G
136 LED annunciator for key of G
148 selector for steady-tempo end-rhythm
150 selector for slowing-tempo end-rhythm
152 end-strum strum-selector
154 end-strum arpeggio-selector
156 power input jack (from power adapter)
160 line-out jack

DETAILED DESCRIPTION OF THE INVENTION

The preferred embodiment of the present invention is an electronic guitar shown in block diagrammatical form in FIG. 1. A selector panel 32 and a tone generator 34 are electrically interconnected by electrical cable 30. Tone generator 34 includes electronic sub-systems for the functions of storage, data management, and output. Selector panel 32 selects chord-types, music endings, voices, music keys, beats, tempos, volumes, and power on-off. The selector panel 32 also has LED's to indicate the active voice, music key, and beat selections.

Figure 2:
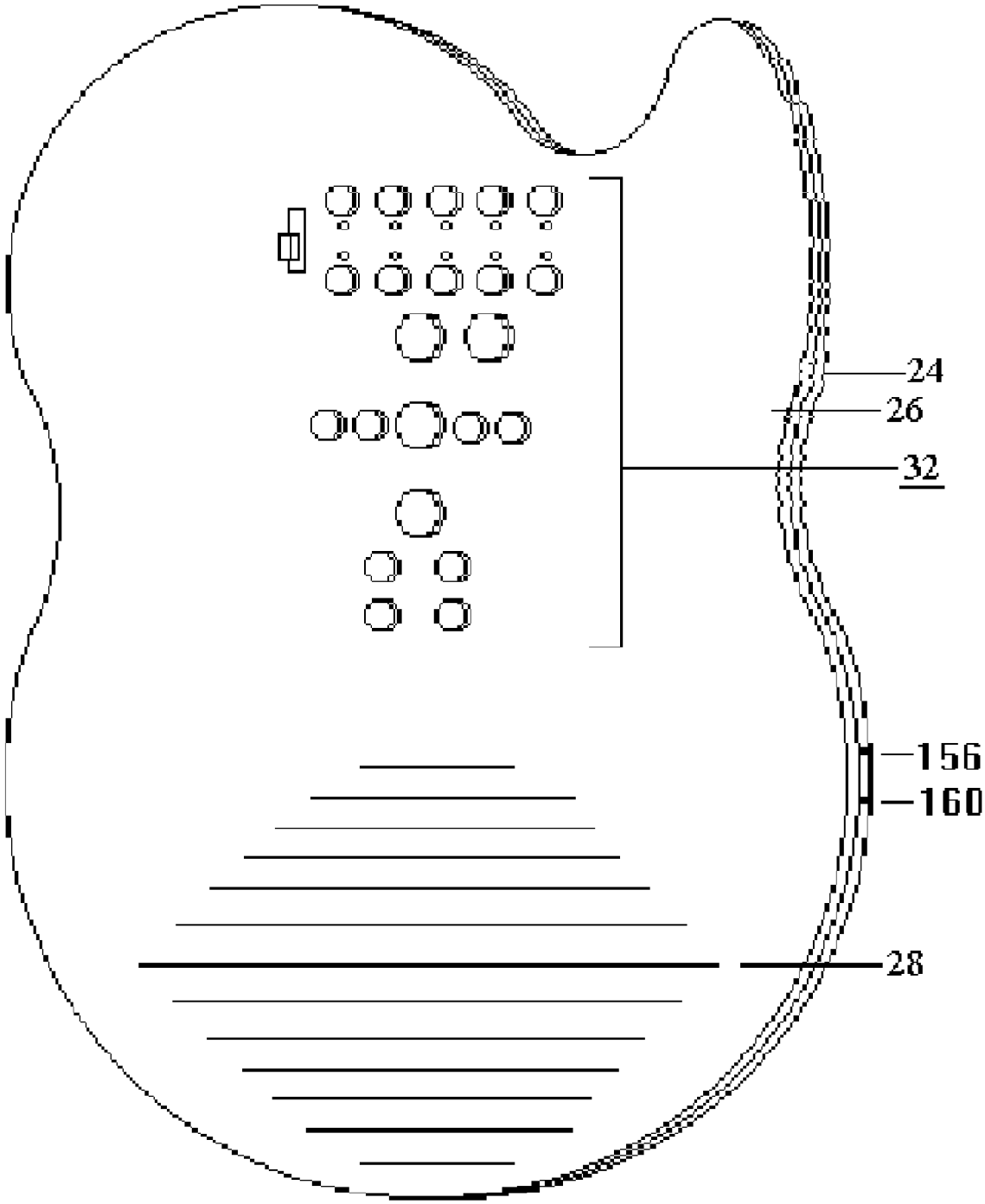
FIG. 2 is a perspective view of the face of the preferred embodiment showing the location of the selector panel.

The block diagram of FIG. 1 is physically implemented in the preferred embodiment depicted in FIG. 2. This instrument has a guitar-shaped body consisting of a back-body 24 and a front-body 26, but lacks the neck that is normally expected as part of a guitar. These shell components are constructed as conventional plastic moldings. Selector panel 32 and tone generator 34 of FIG. 1 are conventionally mounted inside the front-body 26 with the selector buttons and LED's of the selector panel 32 protruding through holes in the front-body 26.

The output sub-system of tone generator 34 includes the conventional components of an audio amplifier with volume control, a loudspeaker, and batteries, the latter two of which are not shown in the Figures. A power-input jack 156 accepts power from a power adapter when the portability enabled by the internal battery-powered supply is not required. Use of the line-out jack 160 causes the internal loudspeaker (not shown) behind speaker grill 28 to be automatically disconnected when a plug from a headphone or external loudspeaker is inserted. The power-input jack 156 and line-out jack 160 mount on circuit boards (not shown) and extend through holes in the side-wall of back-body 24. Conventional components are used to interconnect the power input and audio output sub-systems to the tone generator 34.

Back-body 24 and front-body 26 are attached to one another using conventional techniques so that the two body portions mate at about half-depth of the mated pair. In its preferred embodiment, the assembled instrument is 28 cm wide, 38 cm long, and 5 cm deep (11 inches by 15 inches by 2 inches). Although these dimensions may be easily scaled in other embodiments to accommodate users of different sizes, these dimensions are preferred because the resulting instrument can be carried in an attaché case. These body components are similar in general design and in manufacturing technology to bodies used on typical 37-key musical keyboards. The speaker-grill 28 is an integral part of the molded front-body 26 having long, narrow, stepped slots to emit sound while preventing the entry of debris.

Figure 3A:
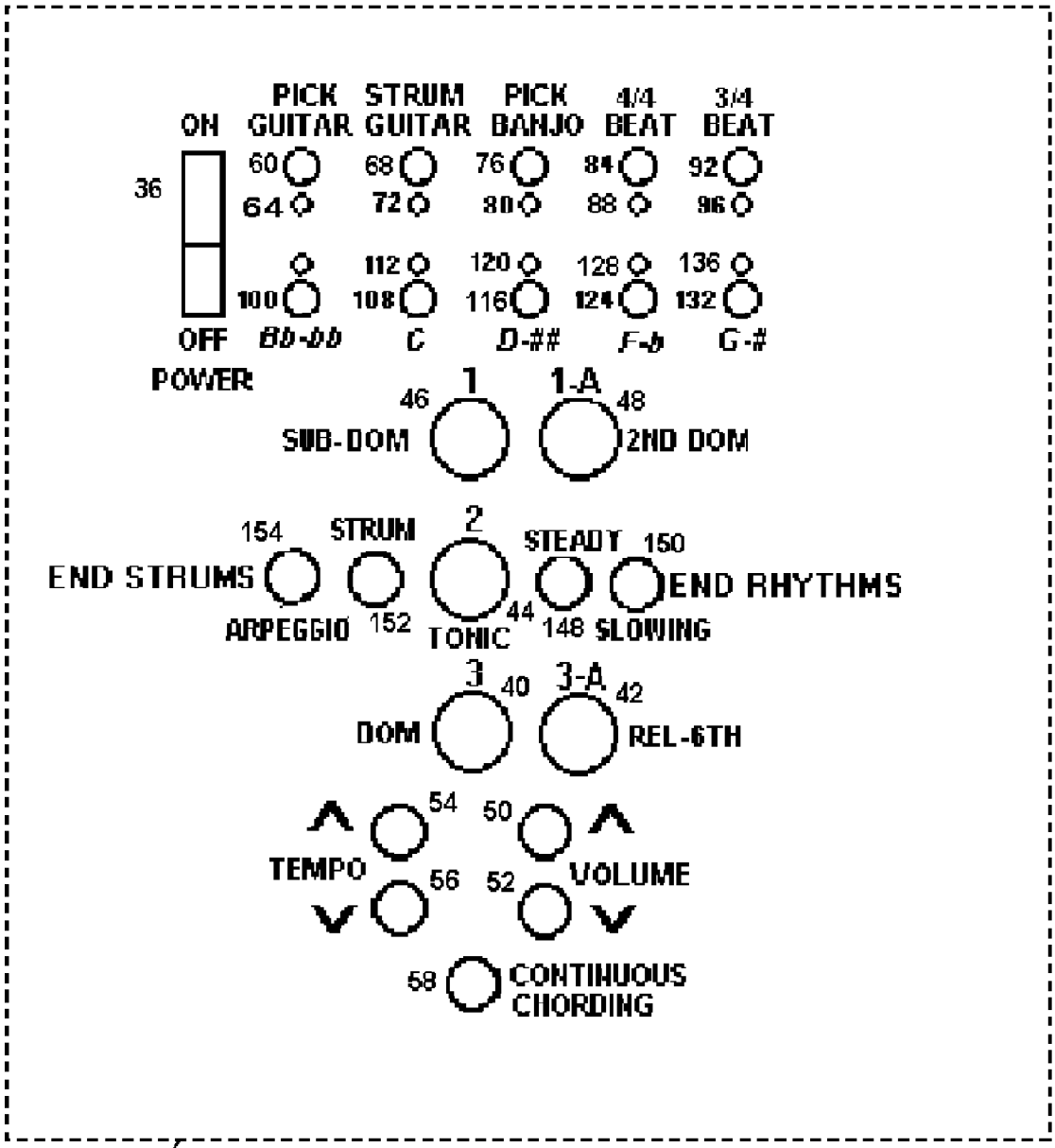
FIG. 3A shows the layout of the selector panel in one composite embodiment.
Figure 3B:
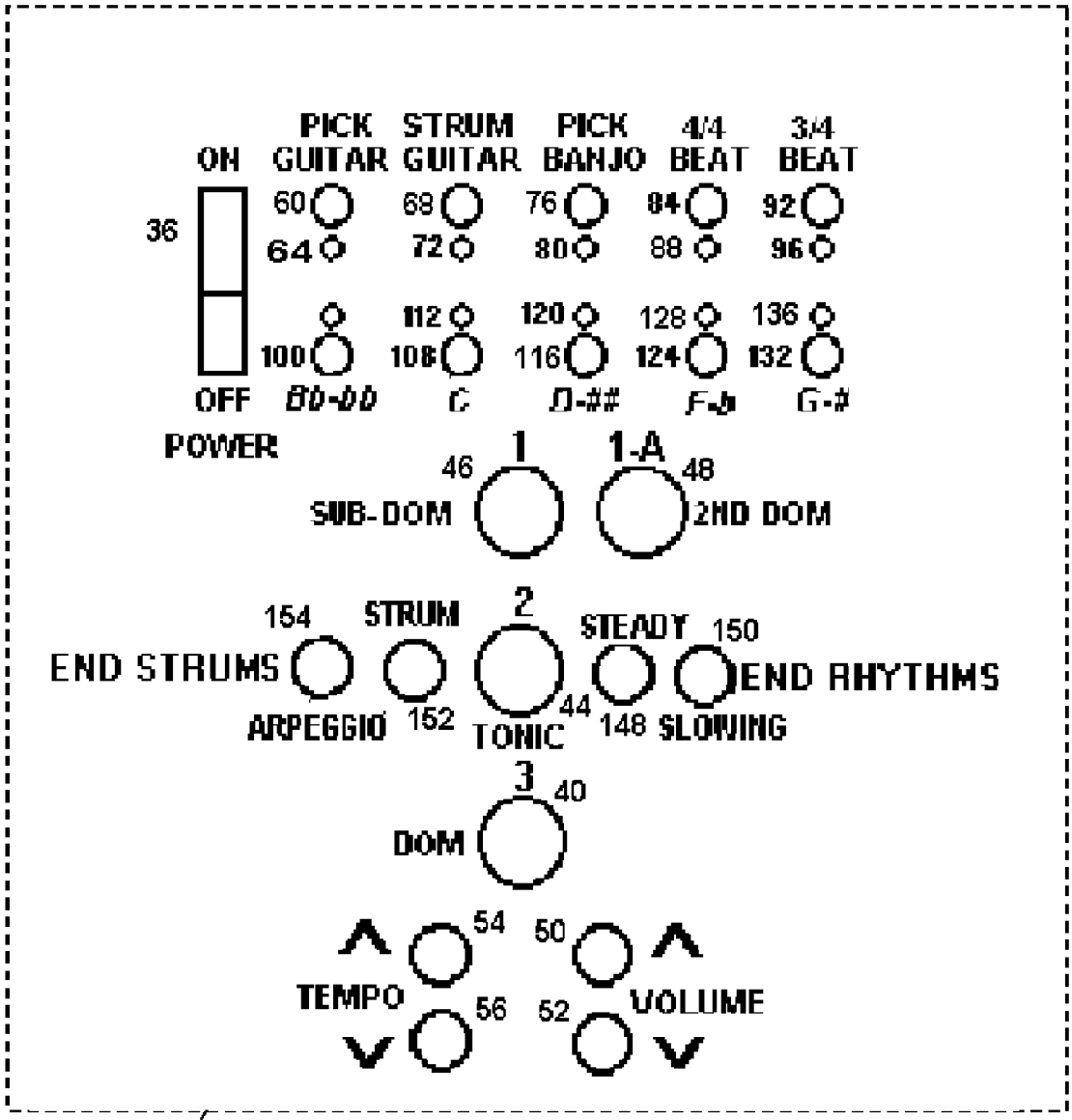
FIG. 3B depicts the selector panel layout of the preferred embodiment.

The detailed layout of selector-panel 32 can be seen in FIG. 3B. The instrument disclosed in the present invention has no strings, and as aforementioned the preferred embodiment, shown in FIG. 2, has no neck.

Five of the selectors shown in FIG. 3B control the setup of the described instrument of the present invention and need no associated LED annunciators, namely: a power on-off selector 36, volume-up and volume-down selectors 50 and 52, and tempo-up and tempo-down selectors 54 and 56. In the preferred embodiment of the present invention, the control selectors and the playing selectors use round plastic finger-buttons, except for the sliding power on-off selector 36, however it will be recognized that other forms of controls may be easily substituted to accomplish the equivalent functions with an alternate mechanical interface within the scope of the present invention.

Ten additional set-up selectors have associated LED annunciators to indicate which voice, beat, and key have been selected. These are:

a Pick-Guitar selector 60 with LED 64;
a Strum-Guitar selector 68 with LED 72;
a Pick-Banjo selector 76 with LED 80;
a 4/4-Beat selector 84 with LED 88;
a 3/4-Beat selector 92 with LED 96;
a Key of Bb selector 100 and its LED 104;
a Key of C selector 108 and its LED 112;
a Key of D selector 116 and its LED 120;
a Key of F selector 124 and its LED 128; and
a Key of G selector 132 its LED 136.

After the above setup controls have been used to establish the mode for playing a particular musical selection, the disclosed instrument is ready for performance of the piece. Four playing selectors are chording selectors for the play of chording phrases: a #1 sub-dominant chord-type selector 46, a #1A second-dominant chord-type selector 48, a #2 tonic chord-type selector 44, and a #3 dominant chord-type selector 40. Another four playing selectors are music-ending selectors to play music-ending phrases. These include two end-rhythm selectors and two end-strum selectors. The two options for end-rhythm are chosen between a steady-tempo selector 148 and a slowing-tempo selector 150, while the user chooses between end-strum options with strum-selector 152 and an arpeggio-selector 154.

The layout of the selectors in the preferred embodiment takes into account ergonomic considerations so as to minimize both physical and mental playing efforts. The instrument can be played with only one hand, independent of right or left, and with only three fingers, one at a time. The three fingers will normally rest in position side-by-side over three of the selectors (40, 44, and 46) to play the three primary chords, namely, tonic, sub-dominant and dominant. In an embodiment intended for a child or beginner (FIG. 3C) only these three chording selectors are available, whereas in the preferred embodiment of FIG. 3B a second-dominant chord-selector (48) is available to be activated by extension of a first finger. In another alternate embodiment, extension of a third finger will activate the relevant-sixth chord-selector (42). The second finger can be extended to access music-ending selectors 148 and 150, or retracted for access to music-ending selectors 152 and 154. It will be recognized in light of FIGS. 3A and 3B that these motions describe right-handed play, but that the given layout could be mirrored or the motions of extension and retraction could be interchanged in order to accommodate left-handed play. The set-up selectors, being used less frequently, are divided into two groups and placed on either side of the central chord-selection playing area for easy access between songs or occasional changes of music-key, tempo or volume.

An inventive concept herein relates to a system and arrangement for selecting and playing chords, notes, and music endings. These can be played with a large variety of sound combinations. The feasible tone-generating, sound-creation circuitry and physical assemblages are well known to those having ordinary skill in the art so that a description of specific controls and physical assemblages is beyond the scope of this discussion. This includes the associated electronics to store, manage, and output the sounds. For example, feasible circuitry could include a microprocessor and a keyboard scanner, or it could operate as an interrupt-driven system. It could work with either a digital or analog storage system. A digital storage system could include an analog-to-digital (A/D) converter. This could enable factory loading of pre-recorded chording phrases and music endings into flash-memory storage. Such a storage system could use a digital-to-analog (D/A) converter to retrieve factory-loaded recordings from a flash-memory storage. These are just some of the technologies known to those of ordinary skill in the art of sound reproduction.

Alternatively, the circuitry could use a special form of EEPROM (Electrically Erasable Programmable Read-Only Memory) known as a Direct Analog Storage Technology (DAST™) device. The DAST™ components designed by Information Storage Devices, a subsidiary of Winbond Electronics Corporation, are capable of storing from 20 seconds up to eight minutes or more of audio information. When managed by a microprocessor, a DAST™ device eliminates A/D and D/A conversions for storing waveshape data in solid-state memory. Since tempos stored in DAST™ devices cannot be varied without unwanted pitch changes, traditional sets of recordings may be provided in memory for each discrete tempo setting.

A sound studio can record, clip, and sequentially store the desired rhythm-segments of live guitar and banjo music. Alternatively, customized guitar-music workstations at some recording studios may already offer the desired recordings. These recordings can be transferred by compact disc or other means to production equipment to be loaded into musical instruments at their time of production. These and related methods are known to those of ordinary skill in the pertinent arts.

With regard to the two-piece body of the present invention as described above, the preferred method of assembly is from molded plastic parts, though many other options are available to meet special conditions or market needs. The assembly may use the same technology as low-cost musical keyboard bodies, and at comparable cost. This instrument may be designed and manufactured by an existing musical-keyboard factory using techniques that are well known to those of ordinary skill in the art.

The electronic musical instrument of the present invention is simple and inexpensive to manufacture, offering a reasonable potential for mark-up and profit to manufacturers, distributors and music retailers while still offering a good value to those users who are not instrument-musicians. This instrument is intended for adults as well as adolescents. Its external parts count of playing-selectors or keys, set-up selectors, LED annunciators, and speakers is significantly reduced compared to most musical keyboards. This simplicity, and its implied potential for profitability, is shown in the table of FIG. 5 comparing an electronic guitar produced under the present invention to three low-cost musical keyboards, two of which are sold by a major chain of toy stores. While the circuitry may differ, all are similar with regard to structural parts and manufacturing techniques. Also, the sizes of instruments are similar enough to meaningfully compare complexity. (Prices given are intended to be relative for comparison purposes rather than absolute.) Item B for $15 is a child's keyboard having 37-keys, while the $20 keyboard of item C is intended for older children. The $100 item D is a 61-key full-size keyboard for adults from a major manufacture having a keypad, a transposer, a metronome, a microphone jack with volume control, and a MIDI in/out jack. It has a read-out panel that pictures notes-played on a music staff and on a keyboard sketch. The electronic guitar (item A) that is described here as the preferred embodiment of the present invention is intended for adolescents and adults with an alternative embodiment having a limited-capability for aspiring children.

OPERATION OF THE INVENTION

The instrument of the present invention is set up by using the set-up selectors, having associated LED's, on selector-panel 32. Chording selectors and music-ending selectors cause pre-recorded guitar and banjo elemental chording-phrases and music-ending phrases to be replayed from the instrument's permanent memory to produce a continuum of extemporaneous accompaniment music. These may be replayed in arbitrary sequences, for arbitrary durations, through tone generator 34. A conventional amplifier (not shown) and conventional speaker (not shown) are included in the output sub-system of the tone generator along with a conventional line-out jack for a headphone or external speaker. Conventional circuitry powers the unit as needed, using either small internal batteries or power input from an AC power adapter.

An initialization sequence begins when the user causes power to be applied to the instrument by activating the power on-off selector 36, located with other set-up selectors on selector-panel 32. This is shown at step S1 in the flowchart of FIG. 6A. Following a customary power-on self-test, the sequence proceeds to step S2 of the flowchart, where the data management sub-system of tone generator 34 (FIG. 1) obtains initialization parameters from a read-only memory. The guitar is enabled to begin play in strum guitar style (lighting LED 72) in the key of C (as signified by LED 112) using the 4/4-beat mode (with LED 88 illuminated). Initialization also places both volume and tempo at midrange settings (say, 5 of 9). In step S3 the appropriate connections are made to the output sub-system. Other setting information is coordinated with the storage sub-system in step S4, to arrange for designated recordings.

The storage sub-system provides the correct chord recordings and music-ending recordings through the data management sub-system. Step S5 shows that the data management sub-system continually scans for changes in chording and music-ending selector designations.

As the user plays the instrument in a performance, the chording and music-ending selectors of the selector panel will change, in step S6. When set to play in the key of C, selector-1 (46) designates an F-chord as the sub-dominant chord-type. Selector-2 (44) designates a C-chord, C being the tonic chord-type. A tonic chord is also known as a root-chord or a home-chord and is obvious because most North American songs start with this chord and essentially all end with this chord. In the preferred embodiment of the present invention, the tonic chord-type selector-2 (44) is located vertically between the upper sub-dominant (selector-1, 46) and lower dominant (selector-3, 40) chord-type selectors to be played by the middle finger as the home chord. Some people can intuitively feel the music rising and falling from the position of the home chord at selector-2 (44). When it rises, one often plays the upper selector-1 (46), and when it falls there is often a tendency to play the lower selector-3 (40). This may aid in intuitively chording and interspersing notes. Continuing, in the key of C, selector-3 (40, dominant chord-type) is set to a G7-chord, while selector-1A (48) will be used to choose a D7-chord, the second-dominant chord-type, which is sometimes referred to as the "5-of-5's" chord. Since selector-1A (48) is used in only a few songs, and typically only once per verse, it is convenient to place this selector near selector-1 (46) to be played with the first finger.

The data management sub-system also monitors and updates for the latest changes to the set-up selector designations, subsequent to the initialization process. The process flow goes to output sub-system in step S7, where the sound information is amplified and output through the conventional speaker (not shown), or through line-out jack 160.

Pressing the picked-banjo selector 76 changes the instrument to banjo finger-picking rhythm style voice and lights its associated LED 80, while pressing strum guitar selector 68 changes the instrument back to strumming style. Lockouts supplied by the control logic prevent the strummed guitar, finger-picked guitar, and finger-picked banjo sounds from being played together.

The set-up options of music key, beat, tempo, volume, and voice (strummed-guitar, finger-picked guitar and finger-picked banjo) are easily changed during a song, as between verses, but remain unchanged unless individually altered. A user can play the first verse of a song in a guitar voice and quickly select a banjo voice for verse two with a resulting output being immediately compatible because beat, tempo, volume, and music-key selections remain unchanged. Music-endings automatically match the voice, music key, beat, volume, and tempo in use. Priority is given to the last-pressed selector within each of these selection groups. Similarly, the last-pressed of chording selectors 40, 44, 46, and 48 takes priority. Softly audible feedback clicks may be provided with beat, voice, music key, tempo, and volume selections without interfering with changing them during a song.

Figure 6A:
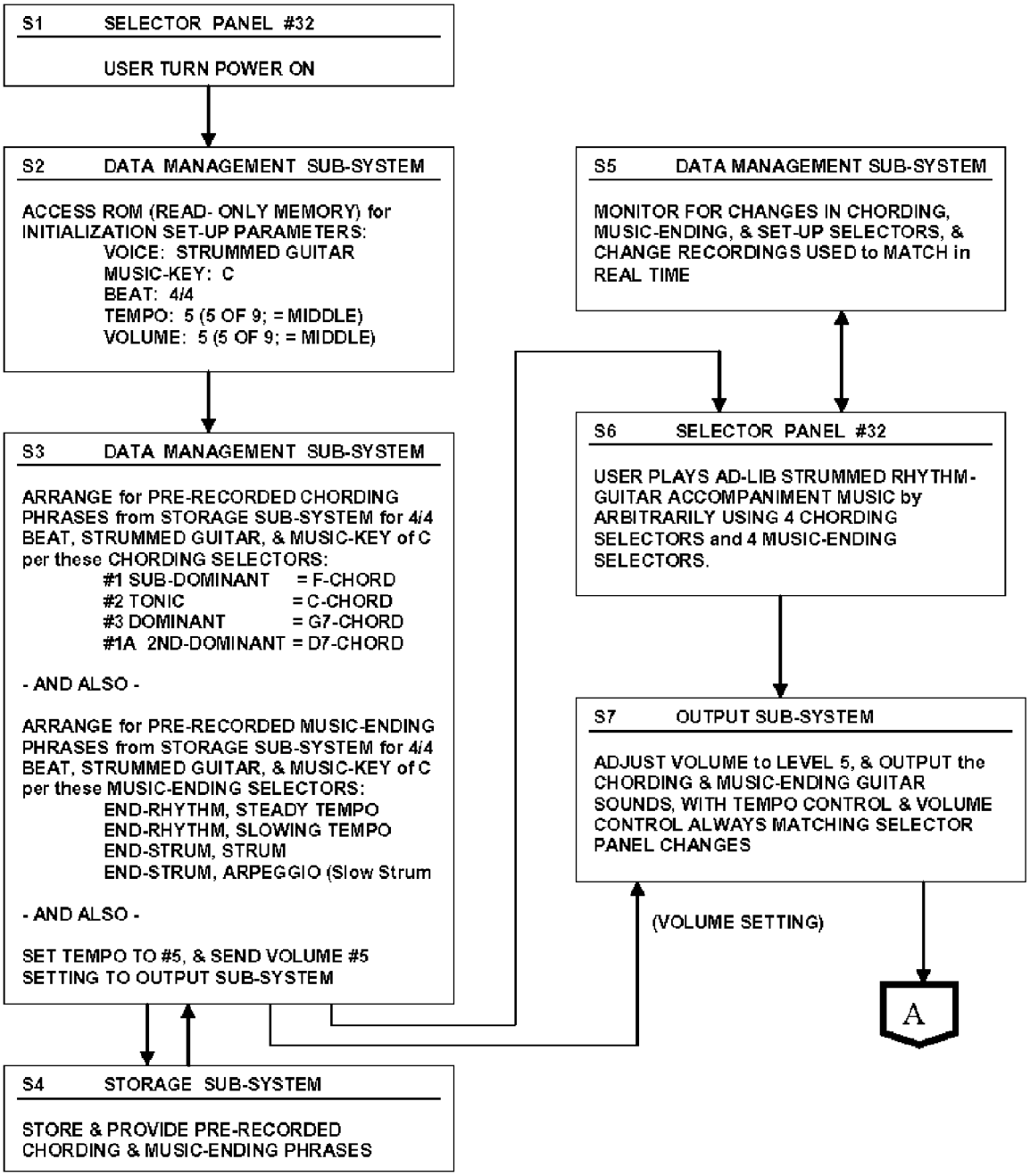
Figure 6B:
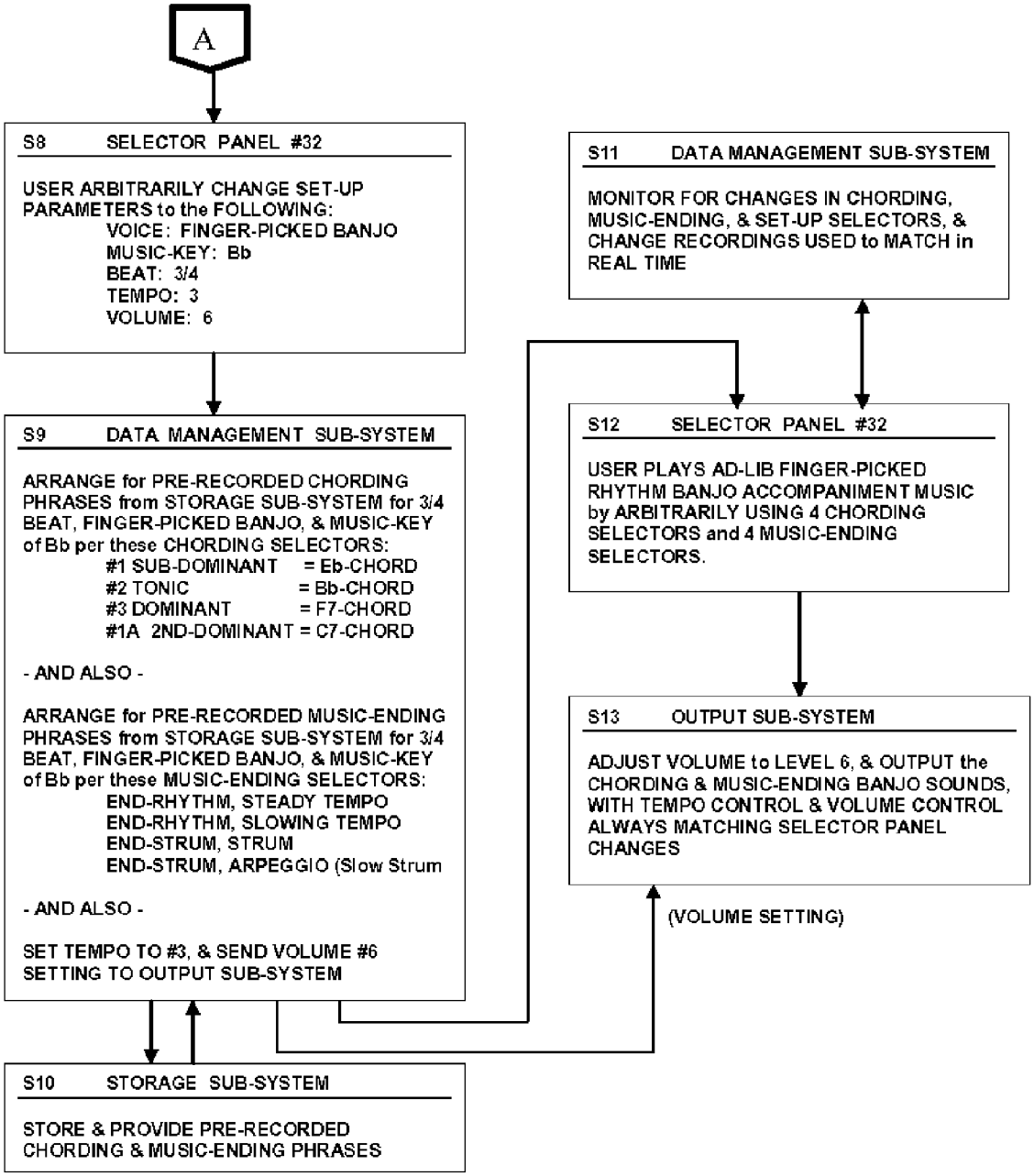
FIG. 6B flowcharts a typical system operation when the voice, music key, beat, tempo, and volume options, have each been changed.

See FIG. 6B for a flow chart of an optional system operation. The process flows from step S7 in FIG. 6A to step S8 in FIG. 6B. The example in step S8 shows that the user made a complete change from the initialization settings. Now, the voice selection is finger-picked banjo in music key Bb on a 3/4-beat, the tempo setting has slowed from 5 (midrange) to 3, and the volume has increased from 5 (midrange) to 6. The process then flows to step S9 as the data management sub-system constantly updates in accord with changes in the chording selector.

Now, selector-1 (46) designates an $E^b$-chord as the sub-dominant chord-type; selector-2, the tonic chord-type, points to a $B^b$-chord; selector-3 for the dominant chord-type, designates an F7-chord; and selector-1A designates a C7-chord as the second-dominant chord-type. The data management sub-system also updates the music-ending designations accordingly for banjo-voiced endings. The end-rhythm steady-tempo selector will provide a 3/4-beat rhythmic-ending at a steady tempo, and the end-rhythm slowing-tempo selector will provide a 3/4-beat rhythmic-ending at a slowing tempo. The end-strum strum selector will provide one ascending strum, while the end-strum arpeggio selector will provide one ascending arpeggio strum. The data management sub-system sends the volume-setting data to the output sub-system to modify the volume level.

This updated setting information is coordinated with the storage sub-system in step S10 to arrange for designated recordings. The storage sub-system provides the correct chord recordings and music-ending recordings through the data management sub-system. This occurs when requested by the chording and music-ending selectors of the selector-panel in step S12. Step S11 shows that the data management sub-system continually scans for changes and updates the chording and music-ending selector designations. These continually change as the instrument is played to create a music performance. It also monitors and updates for any subsequent changes of the set-up selectors. The process flow goes to the output sub-system in step S13 where the sound information is amplified and output through the conventional speaker (not shown) or through line-out jack 160.

Although each chording-selector replays chording-phrases that were recorded from a conventional guitar or banjo, the presently described instrument is played with only one finger at a time. A performance is accomplished by playing on only four chording selectors 40, 44, 46 and 48, and four music-ending selectors 148, 150, 152, and 154. As each chording selector is held depressed it causes continuous chord music as defined by the currently selected options. These options are music key, voice, beat, tempo and volume. These eight selectors are mutually exclusive, and the last-pressed selector takes priority.

This instrument provides the five most-used major music keys of Bb, C, D, F, and G. Together they cover all voice ranges, and most songs common in the western world. The excluded music keys are not needed by novices, and seldom by many instrument musicians. Excluding those music keys simplifies the playing and the manufacture of the instrument.

Pressing any music-key selector will instantly set the instrument to the designated new music key. It will also light the corresponding LED, extinguishing the LED of the prior music-key. These music-key selectors and the associated LEDs that indicate their activation are:

- a key of Bb (sometimes referred to as "2 flats") selector 100 and LED 104;
- a key of C selector 108 and LED 112;
- a key of D (perhaps known as "2 sharps") selector 116 and LED 120;
- a key of F ("1 flat") selector 124, and LED 128; and
- a key of G ("1 sharp") selector 132, and LED 136.

The voice, music key, beat, and tempo selectors together determine which pre-recorded chord-set, and music-ending set are needed from storage. The chord-set is assigned to chording selectors 40, 44, 46 and 48. The music-ending set is assigned to music-ending selectors 148, 150, 152, and 154. The tempo and volume of the chord music can be changed at will during play between song verses and the tempo and volume of the music endings will automatically track the changes. Therefore, a player needs to make only two choices while playing, namely, which chording selector or music-ending selector to play next, and when. That is easy and intuitive when one knows the song.

The instrument disclosed in the present invention replays a different basic music-phrase recording for each combination of chord-type, voice, music key, and beat. The chord-types are tonic, dominant, sub-dominant, and second-dominant. The voices of the music chords and music-endings are strummed-guitar, finger-picked guitar, and finger-picked banjo. The music keys are Bb, C, D, F, and G. The beats are 3/4 and 4/4. The music endings are two rhythmic-types, and two strum types. This instrument does not accommodate some few songs with other chords that are extra prominent, recognizing that other chords that are subdued can often be ignored, as with a conventional guitar.

The chording phrases are rhythmic chords. The chord music plays in continuously-repeating mode while any one of chord-type selectors 40, 44, 46 or 48 is held depressed. When quickly pressed and released there is only enough time to play the lead-note of a strummed chord. Using the chording-selectors rapidly in this manner plays notes and note-runs between strummed chords. To accomplish this, the chords must have an open style; that is, each chord is recorded as a single picked note followed, after a very short delay, by a strum. The delay between the note and the strum is no longer than what is necessary for a typical user to allow the first picked note to play while avoiding play of the strum that follows. The lead-note is always acceptable so that there is never a need to choose which note to intersperse. This feature is appropriate on songs with chords that change on the first beat of a measure as do most 4/4-beat songs and many written for 3/4-beat. This enables a novice to greatly enhance strummed chord music. Using other buttons to play notes between chords would exceed the ability of a novice.

Volume and Tempo are set at mid-range at power turn-on. Volume-up and volume-down selectors 50 and 52 adjust volume by one small step at each press. Likewise, tempo-up and tempo-down selectors 54 and 56 adjust tempo by one small step of about 18 BPM (beats per minute) at each press. From a center point of 134 BPM, tempo may range from 60 to 208 BPM in discrete steps so as to accommodate the selection of phrases that have been individually recorded for each choice of tempo. This avoids the complexity that would be needed in order to overcome the unwanted changes of pitch that would accompany a continuously variable change of tempo. The tempo and volume controls can be changed during play as between verses of a song. This can be done on the preferred embodiment with the little finger of the playing hand. Volume and tempo changes affect both the chord music and the music endings.

The 3/4 and 4/4 beats are the most used in North American songs. Other, less frequently used, derivative beats may be obtained by adjusting the tempo. For example, the 3/4-beat selector 92 can be made to effectively provide the derivative 6/4, 6/8, 9/4, 9/8 and 12/8 beats. Likewise, by adjusting the tempo, the 4/4 beat selector 84 effectively provides the derivative 2/2, 2/4 and 4/2 beats. Derivative beats are adjusted intuitively through control of the tempo rather than being set by the user to a specific count.

The assortment of music endings provided in embodiments of the present invention is both unique and important. While pre-recorded music phrases must be supplied for each chord type in each music key, the instrument of the present invention has been greatly simplified by supplying pre-recorded music endings only in the tonic chord of each music-key. This accommodates most songs common in North America, essentially all of which end in the tonic chord. Four music-ending selectors provide four types of optional endings that always automatically match each chosen instrument set-up combination, thereby greatly simplifying their playing.

Good music endings are very important. Music performances that start and end well can be well-regarded, even with minor flaws in between. But automated one-finger chording is difficult to end well without automated music-endings. It is also boring and dull without some professional endings. Therefore, automated music-ending options are provided in strummed-guitar, finger-picked guitar, and finger-picked banjo voices.

The four music-ending selectors behave as follows, where in all cases these music-endings will be at the selected voice, tempo, volume, and music key, and regular chord cycles resume at the next press of chord selector 40, 44, 46 or 48.

(1) Steady-tempo end-rhythm selector 148 provides music-endings of two rhythm-cycles followed by a single ascending strum of the five lower notes of a tonic chord;

(2) End-rhythm selector 150 provides slowing-tempo music-endings which start at the selected tempo and progress in a continuously-slowing manner;

(3) End-strum strum-selector 152 provides music-endings that will be a single ascending strum of the five lower notes of a tonic chord; and (4) End-strum arpeggio-selector 154 provides a single ascending arpeggio of the five lower notes of a tonic chord.

The memory of the instrument in the preferred embodiment will be pre-loaded with 200 recordings, assuming that the tempo is changed electronically without requiring additional recordings. The 200 recordings provide 120 instances of chord music, plus 30 for steady-tempo music-endings, 30 for slowing-tempo music-endings, 10 for strum music-endings, and 10 for arpeggio music-endings. The 120 pre-recorded chord phrases are required in order to supply each of two beats in three voices, five music-keys, and four chord-types. Since music-endings are only present in the tonic chord, their number is reduced by a factor of four to result in the need for only 30 recordings per music ending. Furthermore, since the strummed endings do not require support in either the finger-picked guitar or finger-picked banjo voices, the strummed endings are reduced by an additional factor of three so that only 10 such recordings are required for each of the strum and arpeggio endings.

Since each of these recordings is under 2-seconds the total memory required for all music phrases amounts to about six minutes. This storage time is minimal compared to the storage time for pre-recorded melodies on typical musical keyboards. Chords Bb, C, F, G, D7, C7, G7, and A7 are duplicated in the chord-sets of the five music keys, instead of being shared between key-sets, because the guitarist's tempo could vary slightly between recordings of the different music keys. To fit together well in a continuum of music they need to have the same tempo. In FIG. 7 it can be seen that of the 20 possibilities that would result from four chord types for each of five music keys there are only 12 unique chords shown in the table. If these chords are perfectly matched in tempo, they can be shared to reduce memory requirements from 120 to 72 due to 48 duplications (eight duplicate chords each supported in two beat formats and three voices). This is possible if taken from recordings on an excellent music workstation previously recorded from live instruments.

When the instrument is turned on and initialized in the preferred embodiment, a selected chord will play only while the corresponding chording selector is active. In an alternate embodiment, a continuous-chording selector 58 is added to the selector panel as shown in FIG. 3A. When the continuous-chording selector 58 is momentarily pressed, the instrument enters a continuous chording mode such that when any chording selector 40, 44, 46 or 48 is subsequently activated its chord will continue to play until superseded. In this mode each chord can be superseded by another of the chording selectors or by one of the music-ending selectors 148, 150, 152, or 154. It is this continuous-chording mode that enables a user to play an alternate embodiment of the presently described instrument with only one finger at a time. The continuous chording mode may be canceled by re-initializing the instrument through a power cycle, or yet another embodiment may provide that the continuous-chording selector 58 act as a toggle switch.

Figure 3C:
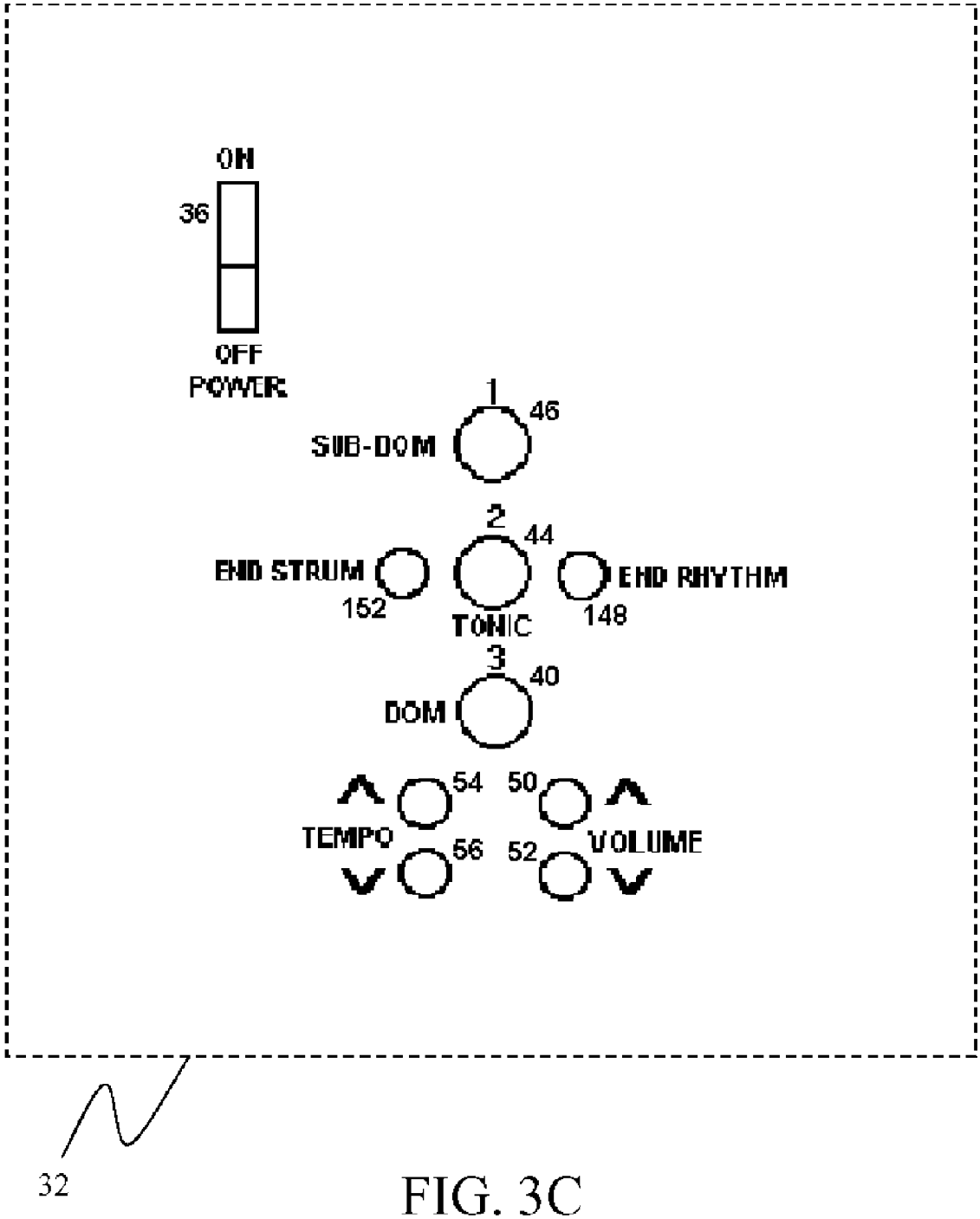
FIG. 3C depicts the selector panel layout of an alternative embodiment that has been minimized for use by a child.

An embodiment of the selector panel shown in FIG. 3C provides only the strummed-guitar voice, 4/4-beat, key of C, and two music-endings. This omits the three voice-selectors, five key selectors, two beat-selectors, and ten associated LED's. This embodiment enables a novice aspiring child to easily play good-quality rhythm-guitar accompaniment music. The 4/4-beat with derivatives covers about 80% of children's songs, and the key of C about 80% of children's songs for children's voices, while the omission of the second-dominant chord-type probably precludes few if any children's songs. It also omits two music-ending selectors. Further, this embodiment could have a neck similar to FIG. 9. The neck could be without selectors; or it could mount the power, volume, and tempo selectors. This instrument could be smaller, and less costly to make, than the preferred embodiment.

Figure 9:
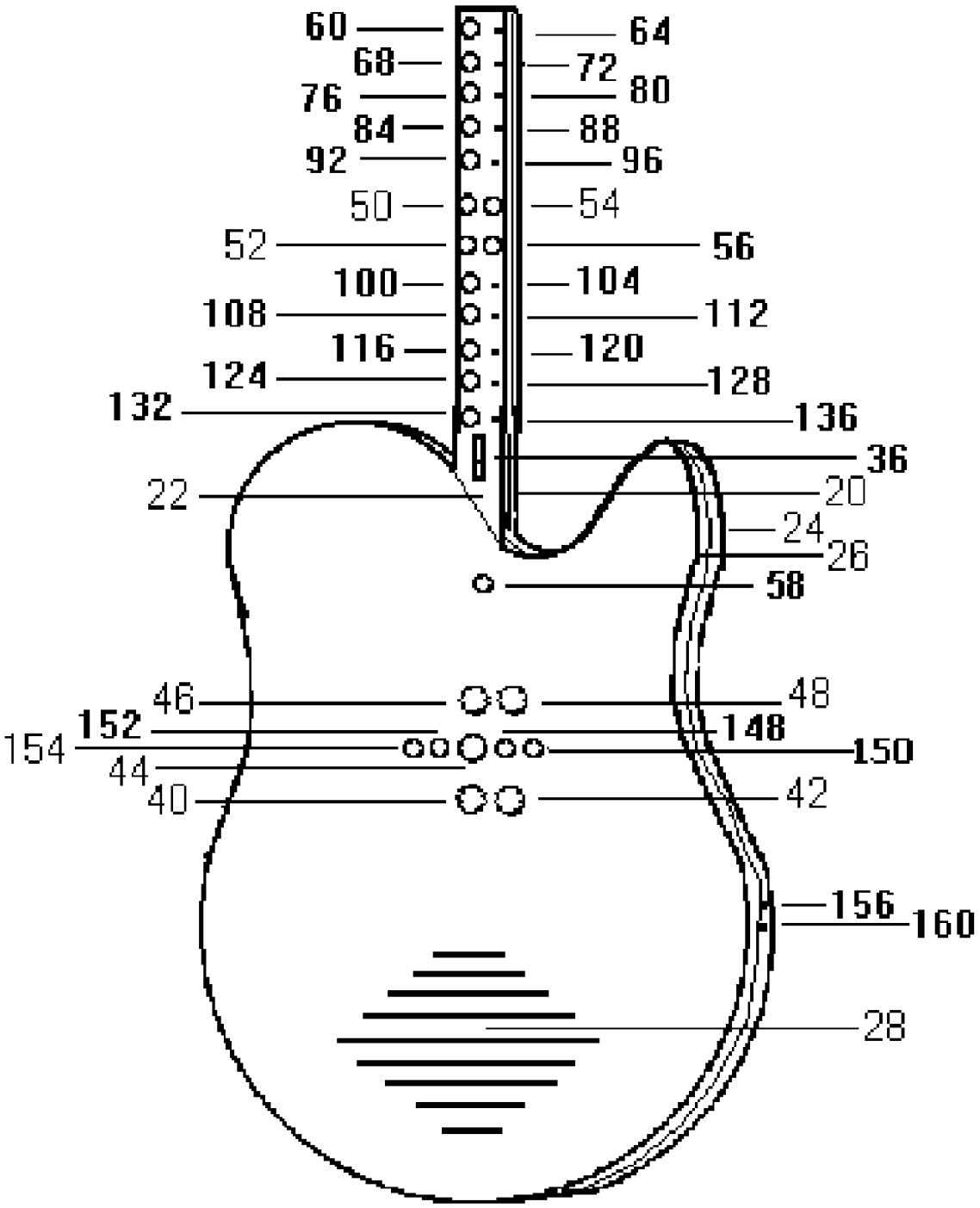
FIG. 9 shows in perspective the face of an alternative embodiment having the addition of a neck upon which set-up selectors are mounted.

FIG. 9 shows an alternative embodiment with a neck. The molded-plastic guitar-neck is added to the previously described body structure. The structural and electrical description used in the preferred embodiment pertains here also, except for locations of selectors. Back-neck 20 and front-neck 22 are separate plastic moldings. Back-neck 20 may be conventionally and permanently attached to back-body 24 and front-neck 22 may be conventionally and permanently attached to front-body 26 or the respective body and neck parts may be molded together as separate front and back portions according to manufacturing methods that are generally understood. When used, the assembled neck-pair is preferably about 3.8 cm wide, 33 cm long, and 5.1 cm deep (1.5 inches wide, 13 inches long, and 2 inches deep). The assembled neck-with-body pair is about 28 cm wide, 66 cm long, and 5 cm deep (11 inches wide, 26 inches long, and 2 inches deep).

The neck supports the mounting of the ten control selectors and their associated LED's for five music keys, three voices, and two beats. It also provides mounting for the two tempo selectors and the two volume selectors. This comprises half of the selector panel. The body provides for mounting of the eight playing selectors, including the four large chording selectors, and the four small music-ending selectors, comprising the other half of the selector panel.

The electronic function and operation of the alternative embodiment with a neck is the same as the preferred embodiment without a neck, with one exception. All set-up selectors and associated LED's have been relocated to the guitar neck. Therefore the playing hand can only play chording selectors 40, 44, 46 and 48, and music-ending selectors 148, 150, 152, and 154. This is all that is normally needed to play a song accompaniment. To change tempo or volume during a song, one must use the other hand on the neck. Operating volume controls 50 and 52, and tempo controls 54 and 56, is actually easier, during play, with the other hand. Voice selectors 60, 68, and 76, and beat selectors 84, and 92, are also operated on the neck. Likewise, music-key selectors 100, 108, 116, 124, and 132 are operated on the neck. This alternative embodiment is equally usable by right-handed and left-handed people. Power selector 36 is also located and operated on the neck.

Example of Playing Instructions

For an example of how to play the instrument of the presently described invention, please refer to FIG. 8.

1. Turn Power On and Set-Up: Turn on the Instrument using the power on-off selector. It is now set to play strummed rhythm-guitar music in the key of C, in 4/4 beat, and at middle-tempo and volume.

2. Play Chording Selectors: Place a first finger on chording-selector #1, second finger on #2, and third finger on #3. Press, hold, and release selector #2, then #3, then #1, and then #2, holding for several rhythm-cycles each. The music stops when you release the selectors. The #2 is the Tonic or Root chord and is also called the Home chord. Most songs start, and almost all songs end, with this chord; #1 is the Sub-Dominant chord; #3 is the Dominant chord. Press #1A, an alternative chording-selector, with a first finger and hear the second-dominant chord. Few songs will use this. These four selectors together, will play most songs. A user will hear intuitively when to use each chord as they sing and play songs they have learned.

3. Play Automated Music-Ending Selectors: Again, press, in sequence, selectors #2, #3, and #1 for several rhythm-cycles each. However, this time end by momentarily pressing the adjacent end-rhythm steady-tempo selector with a second finger, instead of the #2 selector. This is an automated music ending that plays two rhythm cycles and a strum. It then stops all music in perfect timing, until another playing selector is pressed. It also automatically matches the key, beat, tempo, volume, and instrument voice that was being played, regardless of whether it was strummed guitar, finger-picked guitar, or finger-picked banjo. Play the song again but with the pressing of the adjacent end-rhythm slowing-tempo music-ending selector to play a slowed rhythmic ending. Press the end-strum strum selector for an alternative strum-ending. The single-strum ending is often used on children's songs, like "Old MacDonald Had a Farm." Press the adjacent end-strum arpeggio selector right after an automated ending to play an arpeggio strum of the root chord for a pleasing end-effect. Sometimes it may sound better to let the music continue between verses and not use an automated ending until the end of the song.

4. Find the proper Music-Key for a Song: Press the end-strum strum selector and hear a strum of the root chord. Then test by singing part of a song silently, or out loud, to find if whether a singing voice can reach all notes when using that key for that song. If a higher key than the initial key of C is needed, progressively press the next higher-lettered music-key selector (D, F, G, then Bb), testing each time until a comfortable key is found. If a lower key is desired, press the next lower-lettered selector (Bb, then G, F, D) in similar fashion.

5. Play the Strummed Guitar and Sing a Song: Start with the simple song shown in FIG. 8A, where the numbers are the finger-selector numbers to press and hold until the next chord change. This plays the "Red River Valley" with the strummed guitar in the key of C with a 4/4 beat finishing with an automated strummed-guitar music-ending which is also in a 4/4 beat.

6. Play the Finger-Picked Guitar: Press the finger-picked guitar selector and again play and sing the "Red River Valley" following the instructions of FIG. 8B using the end-rhythm automated music-ending selector at the end and notice that the instrument automatically plays a finger-picked guitar ending. This plays the song with the finger-picked guitar in the key of C with a 4/4-beat and an automated finger-picked guitar music-ending in a 4/4-beat. This exercise step may be repeated using the finger-picked banjo selector.

8. Change to a 3/4 beat and Play and Sing a 3/4 Beat Song: Press the 3/4 beat selector and play the song shown in FIG. 8C. Use the end-rhythm automated music-ending selector again at the end for an automated 3/4 beat strummed-guitar ending. Change the tempo of the 3/4 beat to play it faster or slower. Notice that the music-ending tempo adjusts automatically.

Pursuant to the above discussion, it will be recognized that the musical instrument of the present invention is unique in that it enables most people who can sing on tune to play, without instrument practice, the rhythmic accompaniment music of a strummed guitar, a finger-picked guitar, and a finger-picked banjo using only one finger at a time. The described instrument replays unaltered, pre-recorded, elemental chorded music-phrases, and music-ending phrases of rhythm-guitar music and rhythm-banjo music so as to produce a lively sounding performance. It enables players to play notes between strummed guitar chords, by using only the same chording selectors that play the strummed guitar chords.

The embodiments of the presently described invention contradict Hall's U.S. Pat. No. 4,682,526 which teaches against using only one chord-type for each chord. Hall stated that such play throughout a song is not acceptably interesting having a tendency to become very mechanical and machine-like, and chose to provide many complex chord permutations selected in a constrained random manner.

Furthermore, though Morikawa's U.S. Pat. No. 4,970,935 teaches that simply replaying as-recorded waveshapes produces tones that lack sufficient variation to avoid sounding monotonous, the present invention succeeds while using as-recorded waveshapes for only one chord-type for each chord. It overcomes monotony by enabling the user to easily intersperse notes between strummed chords, as well as by enabling ease of switching to finger-picked guitar rhythm style or finger-picked banjo rhythm style.

Extreme simplification and supporting automation of the presently invented instrument almost totally preclude musical mistakes by restricting play to only the chords and single notes belonging to the selected chord-set. The instrument requires the use of only three fingers, and only one at a time. One finger accomplishes the equivalent of fretting the strings with one hand, while finger-picking or strumming with the other. Chord-music is played with only four selectors. A first finger always rests on chording selector-one, a second on selector-two, and a third finger on selector-three. With only one home for each finger, they are unlikely to get lost. On rare occasion, the first finger is called upon to press chording selector-1A, and the second finger may finish a musical selection by pressing one of four adjacent music-ending selectors.

The music-endings are automated so that novices can easily time them after the automated chord-music replay. The automated music-endings always match the voice, music key, beat, tempo, and volume in use. The music-endings enhance the music and the four choices provide freedom of expression.

This electronic guitar replays short basic-chord music-phrases and music-ending phrases, pre-recorded from musicians with real instruments. So unskilled novices can simply push chording-selectors and music-ending selectors, to create professional live music. The recordings reproduce the true instrument melodic-sounds, and the true strumming and finger-picking styles. A song can be "finger-picked" in either the guitar or banjo voice, with the same finger-sequence. And changing the key, does not change the finger-sequence. Half of guitarists can't play finger-picked guitar.

This electronic guitar is simplified for novices, by providing only the functional capabilities that novices really need. It plays only strummed and finger-picked rhythm-guitar and finger-picked rhythm-banjo accompaniment music, in the few most-used music-keys, and the few most-basic chord-types.

While the above description contains many specifics, these should not be construed as limitations of the scope of the invention, but rather as illustrations of just a few of the many embodiments of this invention. For example, the instrument can be simplified even further by excluding one or two voices and their controls, or by excluding some of the automated music-ending features or one or two music keys (such as Bb and/or F) with their controls. Other options allow for a foot-pad to control tempo, volume, and/or sustain, etc. Some manufacturers may choose to offer other form factors, such as that of a banjo, mandolin, or a classical figure-eight guitar shape, or a round, oval, or trapezoidal shape, etc.

The present invention accommodates an instrument that has a passive neck that can be held and moved about like a real guitar or banjo. Such a passive neck can be detachable, or telescoping, or can fold into the body for compact travel. These body shapes, and the shape of the presently preferred embodiment can be of varying depth with the overall size being adjusted to fit any shape. The disclosed instrument can be packaged as a joy-stick on a box. The eight playing selectors can mount on the handle of the stick, with simple X and Y motions of the stick to control tempo and volume. The other set-up selectors can mount on the box which would contain the electronics and the speaker.

The body can have a wood-like appearance, or it can actually be made of wood. A plastic body can have a textured finish on some surfaces to resist scratching, and have a gloss finish on other surfaces for beauty. Selector-panel buttons can match their mounting-surface color for minimal distraction from the instrument's appearance, or may have contrasting colors for accent.

A circuit similar to the TAS3001 or TLC320AD81 from Texas Instruments can improve sound and volume from small or cheap speakers. Such circuits provide range compression, digital filtering, fade-to-mute, mixing, and bass and treble tone control. This latter can allow volume variance between guitar and bass-guitar voices that can be pre-recorded together, and hence replayed, together.

To accommodate users who are interested in a more capable instrument, additional chord-types can be added, with minor, augmented, and diminished chords being among the options. The instrument can take on additional music-keys. Additional or different rhythmic-chording voices may be offered that can be played alone or in any combination. Such effects can be recorded together so that their volumes and tempos are controlled together, or they can be recorded separately and blended through an internal audio mixer with separate volume and tempo controls. Additional choices of voice can be a twelve-stringed guitar, nylon-string folk guitar, strummed banjo, mandolin-tremolo chords, strummed mandolin, ukulele, a rhythm-section, and more. For many total voices, a keypad selector can serve all, rather than having many selectors. Additional rhythmic-styles include but are not limited to Latin American and Blues.

A simple record and playback system can be added. This can let users listen to their performance, or demonstrate it to others. Such a feature also allows a user to record songs for later use to lead others in group singing. Recorded songs can be replayed while singing harmony. A headset boom mike would allow the using performer to speak as well as to sing through the instrument's amplifier, to announce songs to be sung, and to lead small groups in singing. An ear-mounted or lapel-mounted microphone would accommodate solo-singing. A special effects sound circuit could be built into the instrument to generate a duet-singing output from a solo input.

A myriad of effects known to those familiar with the recording and reproduction of sound may be included within an embodiment of the present invention or as an accessory to it. Some of these features commonly used on electric guitars and electronic keyboards are: bass boost, fine tuning to match other instruments when implemented using a synthesized tone generator, multi-track recording and playback, MIDI and its in/out jacks and cable, percussion pads, special pre-recorded sound-effects, pre-recorded music introductions, reverberation, fade, and chorus effects.

Pre-recorded songs can be added to the internal storage and played back through the speaker as a teaching tool. These songs would have the words of the first verse and chorus sung with an embodiment of the present invention serving as accompaniment. Since most novices are unlikely to have a collection of song music to use, this would provide them with songs to learn, as well as to sing and play for others. With such a feature installed, allowance would be made for the singing voice to be selectively turned off or muted so that the user can sing with accompaniment as in Karaoke. Alternately, the instrument voice can be turned off so the user can play the accompaniment for the recorded singer. A child's version may add musical and verbal expletives and an LED light-show, using the alternative embodiment with a neck shown in FIG. 9.

An instrument implemented within the present invention may be distributed with a song book coded to chording selector numbers and music-ending selector names as shown in FIGS. 8A, 8B, and 8C. Additional verses could be printed for the user to learn but without the chord-coding. All verses could have print large enough that a group of five can sing together from one book.

Other items that may be built-in or added on include but are not limited to:

- media containing songs to enjoy and to practice playing;
- a basic music-theory book to teach children music theory with this instrument;
- a neck or shoulder strap to support the instrument as a saxophone, or a guitar;
- a custom-fit carrying-case with compartments for accessories as well as song sheets, spare batteries;
- a built-in song-book holder; and
- a built-in bulb-type battery tester.

While the present invention has been described with respect to a preferred embodiment and exemplary alternates, there is no implication to restrict the present invention to preclude other implementations that will be apparent to those skilled in the related arts. It is easily recognized that the described invention may be implemented with a variety of components, therefore, it is not intended that the invention be limited to the disclosed embodiments or to the specifically described details but by the appended claims and their legal equivalents.

What is claimed is:

1. An electronic musical instrument comprising:

(a) an instrument body;

(b) a plurality of selectors mounted to the instrument body, said selectors enabling a player using no more than three adjacent fingers-to play an ad-lib accompaniment in a guitar voice;

(c) a storage means for storage of a plurality of music phrases said plurality of music phrases comprising: chord phrases; and music-ending phrases;

(d) a retrieval means for retrieval of said music phrases from said storage means in response to said selectors being operated one at a time; and (e) an output means for conversion into audible sound of said music phrases as retrieved by said retrieval means, wherein said plurality of selectors comprises:

three chording-selectors, comprising:

a sub-dominant chording-selector, a tonic chording-selector, and a dominant chording-selector, wherein each said chording selector is operative for the selection of corresponding chord phrases;

four music-ending selectors, comprising:

a steady-tempo selector, a slowing-tempo selector, a strum selector, and an arpeggio selector, wherein each said music-ending selector is operative for the selection of corresponding music-ending phrases, and a plurality of set-up controls, comprising:

a beat selector means for selecting between a 4/4 beat and a 3/4 beat;

a tempo control means for adjustment of tempo from about 60 to about 200 beats per minute;

a voice selector; and a volume control.

2. The electronic musical instrument of claim 1, wherein said voice selector selects between voices comprising:

a strummed guitar;

a finger-picked guitar; and a finger-picked banjo.

3. The electronic musical instrument of claim 1, wherein said plurality of selectors further comprises: music-key selectors for the keys of Bb, C, D, F, and G.

4. An electronic musical instrument comprising (a) an instrument body;

(b) a plurality of music selectors mounted to the instrument body, said music selectors comprising:

a plurality of chording selectors, each said chording selector being operative for the selection of corresponding chord phrases, and a plurality of music-ending selectors, each said music-ending selector being operative for the selection of corresponding music-ending phrases;

(c) a storage means for storing a plurality of music phrases said plurality of music phrases comprising:

chord phrases; and music-ending phrases wherein each of said chord phrases comprises a series of one or more bars of a discrete chord, wherein each of said music-ending phrases comprises a series of one or more bars of a music ending, and wherein each of said music phrases may be either pre-recorded or synthesized;

(d) a retrieval means for retrieving said music phrases from said storage means in response to selective operation one at a time of said music selectors; and (e) an audio output means for producing audible sound from the concatenation of said music phrases or portions thereof as retrieved by said retrieval means, said music selectors being arbitrarily operable to automatically generate ad-lib chording tones.

5. The electronic musical instrument of claim 4, wherein sequential operation of one or more of said chording selectors causes selection from a multiplicity of said chord phrases to produce a continuum of ad-lib music.

6. The electronic musical instrument of claim 5, wherein operation of any one of said music-ending selectors following said sequential operation automatically terminates the continuum of ad-lib music by appending a music-ending phrase having the same characteristics of key, beat, tempo and voice as a chord most recently selected by said chording selectors.

7. The electronic musical instrument of claim 4, further comprising a plurality of set-up controls, wherein said set-up controls comprise a power on-off control, a tempo control, and a volume control.

8. The electronic musical instrument of claim 7, wherein said instrument body further comprises: a main body portion; and a neck portion, wherein said music selectors are mounted to said main body portion, and said set-up controls are mounted on said neck.

9. The electronic musical instrument of claim 7, wherein said tempo control further comprises a tempo-up control, and a tempo-down control, and wherein said volume control further comprises a volume-up control, and a volume-down control.

10. The electronic musical instrument of claim 7, wherein said plurality of set-up controls further comprises: a multiplicity of each of voice selectors, music-key selectors, and beat selectors.

11. The electronic musical instrument of claim 10, wherein said music-ending selectors further comprise:

a steady-tempo selector, a slowing-tempo selector, a strum selector, and an arpeggio selector, and wherein each of said music-ending selectors selects the corresponding music phrase that matches the conditions established by the combination of said plurality of set-up controls.

12. The electronic musical instrument of claim 10, wherein said multiplicity of voice selectors comprises:

a strummed guitar instrument voice selector, a finger-picked guitar instrument voice selector, and a finger-picked banjo instrument voice selector.

13. The electronic musical instrument of claim 10, wherein said multiplicity of music-key selectors comprises: music-key selectors for the keys of Bb, C, D, F, and G.

14. The electronic musical instrument of claim 10, wherein said multiplicity of beat selectors comprises: a 3/4 beat selector, and a 4/4 beat selector.

15. The electronic musical instrument of claim 10, wherein said music-ending phrases are provided in all applicable combinations of each tonic-chord in each voice, each music-key, and each beat.

16. The electronic musical instrument of claim 4, wherein said chording selectors further comprise:

a sub-dominant chord-type selector, a tonic chord-type selector, and a dominant chord-type selector.

17. The electronic musical instrument of claim 16, wherein said chording selectors further comprise one or more of:

a second-dominant chord-type selector, and a relevant-sixth chord-type selector.

18. The electronic musical instrument of claim 4, wherein each said chording selector behaves as a momentary switch, and wherein a selected one of said corresponding chord phrases repeats continuously only while said chording selector is activated.

19. The electronic musical instrument of claim 18, further comprising a means of selecting a strummed voice, wherein for said strummed voice each of said chord phrases comprises:

a single picked lead-note compatible with the selected chord;

followed by a brief pause, which is followed by a strum of the selected chord, said brief pause having duration sufficient to allow momentary activation of said chording selector to cause output consisting of said lead-note without said strum.

20. The electronic musical instrument of claim 18, further comprising a continuation selector, wherein activation of said continuation selector causes each said chording selector to change from a primary behavior to a secondary behavior, wherein said primary behavior is that of a momentary switch and said secondary behavior is that of a locking switch, and wherein under said secondary behavior activation of any of said chording selectors causes a selected one of said corresponding chord phrases to repeat continuously until another of said music selectors, either a chording selector or a music-ending selector, is activated.

21. A method of playing an electronic musical instrument, wherein said electronic musical instrument provides appropriately positioned controls to enable a user to play chorded accompaniment music, the method of playing comprising:

requiring the use of only three fingers, one finger at a time, from only either one hand;

positioning each of the three fingers at three respective home locations from where they may be relocated by extension or retraction of the respective finger without necessitating relocation of the hand, wherein each of the three home locations controls a chording selector, wherein a sub-dominant chord is played by activation of a control at a first home location by a first of the three fingers, and a second-dominant chord is played by relocating the first finger from the first home location for activation of a first alternate control, and wherein a tonic chord is played by activation of a control at a second home location by a second of the three fingers, and a set of one or more adjacent music-ending selectors is controlled by relocating the second finger from the second home location for activation of one of a set of second alternate controls, and wherein a dominant chord is played by activation of a control at a third home location by a third of the three fingers, and a relevant-sixth chord is played by relocating the third finger from the third home location for activation of a third alternate control.

22. The method of playing according to claim 21, wherein said music-ending selectors comprise at least one of:

a steady-tempo end-rhythm selector;

a slowing-tempo end-rhythm selector;

an end-strum selector; and an arpeggio selector.

23. The method of playing according to claim 21, wherein said music-ending selectors comprise:

a steady-tempo end-rhythm selector;

a slowing-tempo end-rhythm selector;

an end-strum selector; and an arpeggio selector, and wherein one or more of said music-ending selectors may be accessed by extension or super-extension of the second of the three fingers, and those of said music ending selectors not so accessed may be accessed by retraction or super-retraction of the second of the three fingers.

* * * * *